US006008830A

United States Patent [19]

Yamada et al.

[11] Patent Number: 6,008,830

[45] Date of Patent: Dec. 28, 1999

[54] SERIAL THERMAL RECORDING APPARATUS

[75] Inventors: Keiki Yamada; Masahiko Shimizu; Masatoshi Takahashi; Ichiro Furuki, all of Tokyo, Japan

[73] Assignee: Mitsubishi Denki Kabushiki Kaisha, Tokyo, Japan

[21] Appl. No.: 08/965,040

[22] Filed: Nov. 5, 1997

[30] Foreign Application Priority Data

May 30, 1997 [JP] Japan ..... 9-141327

[51] Int. Cl.[6] ..... B41J 2/51; B41J 2/325

[52] U.S. Cl. ..... 347/171; 347/215

[58] Field of Search ..... 347/41, 171, 215, 347/218, 217; 400/120.01

[56] References Cited

U.S. PATENT DOCUMENTS

| | | | |
|---|---|---|---|
| 4,198,642 | 4/1980 | Gamblin | 347/41 |
| 4,401,991 | 8/1983 | Martin | 347/41 |
| 5,384,587 | 1/1995 | Takagi et al. . | |
| 5,767,875 | 6/1998 | Sawada | 347/41 |
| 5,874,970 | 2/1999 | Saito et al. | 347/41 |

FOREIGN PATENT DOCUMENTS

| | | |
|---|---|---|
| 62-117774 | 5/1987 | Japan . |
| 7-312695 | 11/1995 | Japan . |

*Primary Examiner*—Huan Tran

[57] ABSTRACT

The objects of the present invention are to achieve high quality recording having no stripes between main-scannings at a low cost, a low running cost, miniaturization of the apparatus and low power consumption and shorten printing time. In order to achieve the object described above, the thermal recording apparatus is equipped with a recording head in which p pieces of recording elements for recording dots on the recorded medium are disposed at an interval of k dots in a sub-scanning direction, a first drive means for driving the recording head described above in a main-scanning direction, a second drive means for driving the recording head by a distance of p dots every sub-scanning in a sub-scanning direction, a third drive means for driving a recording medium disposed so that it contacts the recorded medium described above, and a control means for controlling the first, second and third drive means and outputting image data to be recorded on the preceding recorded medium to the recording head described above.

9 Claims, 16 Drawing Sheets

SERIAL THERMAL RECORDING APPARATUS

BACKGROUND OF THE INVENTION

1. Field of the Invention

The present invention relates to a thermal recording apparatus in which an ink of a melt type or a sublimation type provided on a recording medium is recorded on a recorded medium by heat, and specifically to a thermal recording apparatus using a serial head capable of being applied to a printer, a facsimile and a copying machine.

2. Description of the Related Art

Various recording apparatuses for obtaining images such as characters and natural pictures are available. A thermal recording apparatus in which an ink provided on an ink sheet ("recording medium") is recorded on a recording paper ("recorded medium") by heat by means of a recording head such as a thermal head is widely applied to various recording apparatuses. Such a thermal recording device has a simple mechanism, exhibits reliability, and is easy to maintain. For example, when a melt type or sublimation type ink sheet is used, recording is carried out by a pigment or dye ink by virtue of energy given to plural recording elements (thermal resistors) constituting a thermal head. A heating amount (heating energy) given to the heating elements described above is controlled by a number of electric pulses, a duration of such pulses and an applied voltage.

The constitution of such thermal recording apparatus is shown in, for example, Japanese Unexamined Patent Publication No. 62-117774. FIG. 17 is a schematic drawing for explaining this thermal recording apparatus, wherein 1 represents a recording head; 20 represents a platen roller; 3 represents a carriage for moving the recording head 1; 4 represents a guide shaft; 5 represents a recording medium comprising an ink sheet, wound on a feed roll 5*a* and a winding roll 5*b*; 6 represents a recording paper which is a recorded medium; and 7*a* and 7*b* represent guide rollers for the recording medium 5 described above.

The operation of the thermal recording apparatus constituted as described above shall be explained below. The recording head 1 carries out intended recording on the recorded medium 6 through the recording medium 5 by heating unillustrated recording elements (not shown) according to an image pattern. The recording head 1 is arranged opposite to the platen roller 20 extending in a main-scanning direction x. Further, the recording head 1 described above is mounted on the carriage 3 capable of running in the main-scanning direction x and moved along the guide shaft 4 disposed parallel to the shaft direction of the platen roller 20 described above while pressed on the platen roller 20 to carry out recording on the recorded medium 6.

To be specific, the recording medium 5 and the recorded medium 6 are present between the recording head 1 and the platen roller 20, and the recording medium 5 described above is stored in the carriage 3 described above and guided by the guide rollers 7*a*, 7*b* disposed on the both sides of the recording head 1 so that it contacts the recorded medium 6, whereby recording (1 band) according to the first main-scanning is carried out while being wound on the winding roll 5*b* from the feed roll 5*a* according to the main-scanning of the carriage 3. Then, the carriage 3 is returned to a start position (record starting position at the left side), and the recorded medium 6 is moved by the width of the recording head 1 by means of the platen roller 20 in a sub-scanning direction y to carry out the next main-scanning recording. Images are formed by repeating recording in the same manner.

Conventional thermal recording apparatuses are constituted as described above, and therefore there is the problem that stripes (white stripes in a main-scanning direction), or so-called banding, are formed between main-scannings to deteriorate image quality. This is caused by a structural factor originating in a drive accuracy of a recording head or a recorded medium and an uneven temperature distribution in which temperatures at the both ends of the recording head are lower than those of the central part thereof. A degradation in image quality can be solved by driving a recording head or a recorded medium at high accuracy and recording at high accuracy by correcting a temperature distribution in the recording head. In this case, however, the printing apparatus becomes expensive, large and complicated.

In the case of a thermal recording apparatus using a serial head, there is the problem that the running cost in terms of production is increased and the printing time is extended as compared with those of a recording apparatus using a line head. Further, in the case of a portable type thermal recording apparatus using a serial head, there is the problem of large power consumption.

SUMMARY OF THE INVENTION

The present invention has been made in order to solve the problems involved in the conventional thermal recording apparatuses described above. Accordingly, an object of the present invention is to achieve high quality recording having no stripes between main-scannings at a low cost, a low running cost, a miniaturization of the apparatus and low power consumption and shortened printing time.

In order to achieve the object described above, a serial thermal recording apparatus according to the present invention is equipped with a recording head in which p pieces of recording elements for recording dots on a recorded medium are disposed at an interval of k dots (provided that p and k are positive integers which are prime to each other) in a sub-scanning direction, a first drive means for driving the recording head described above in a main-scanning direction, a second drive means for driving one of the recorded medium and the recording head in a direction in which the recording head described above is moved relatively to the recorded medium described above by a distance of p dots every sub-scanning in the sub-scanning direction, a recording medium disposed so that it contacts the recorded medium described above and provided thereon with a recording material for recording on the recorded medium described above, a third drive means for driving this recording medium, and a control means for controlling the first, second and third drive means and outputting image data to be recorded on the preceding recorded medium to the recording head described above.

The above second drive means drives the recording head described above. This achieves high image quality recording having no stripes between main-scannings at a low cost.

Further, the above second drive means drives as well the recorded medium described above. This achieves high image quality recording having no stripes between main-scannings at a low cost and provides an apparatus having a small installation area.

Furthermore, the control means described above controls the first drive means and the third drive means so as to drive them at different times. This achieves high quality recording having no stripes between main-scannings at a low cost and suppresses the power consumption because the third drive means is not operated at the same time as the first drive means, so that the power source can be inexpensive and small.

In addition thereto, one set of recording sections in the recording medium described above is constituted so that it is larger than a recording size on the recorded medium described above. This achieves high quality recording having no stripes between main-scannings at a low cost and low running cost recording.

Further, the driving direction of the recording medium described above is almost the same as that of the recording head described above. This achieves high quality recording having no stripes between main-scannings at a low cost and makes it less liable to produce wrinkles on the recording medium, so that high quality recording can be stably obtained.

A detecting means detects a start point and an end point of recording in a main-scanning line to output a signal to the control means described above is provided, and the control means uses the signal from the detecting means to control the recording head described above so as to operate for recording in coming and going drives respectively. This makes it possible to carry out two way printing and achieves a high speed recording apparatus having a high image quality.

Further, the recording medium described above is constituted so that one set of the recording sections comprises the color materials of yellow (Y), magenta (M) and cyan (C), and the control means described above is constituted so that it controls the recording head to repeat recording three times for yellow (Y), magenta (M) and cyan (C) on the same main-scanning line with a recording head described above. This achieves the recording apparatus having a high image quality, close to that of a photograph.

Furthermore, the recording medium described above is formed in a band shape and constituted so that a start part is connected to a winding reel and an end part is connected to a feed reel, and the used part is wound on the winding reel described above. The control means described above controls the third drive means so that the used part of the recording medium is rewound for reuse. This makes it possible to use the recording medium many times for recording and achieve low cost operation.

DESCRIPTION OF THE PREFERRED EMBODIMENTS

Embodiment 1

Figure 1:
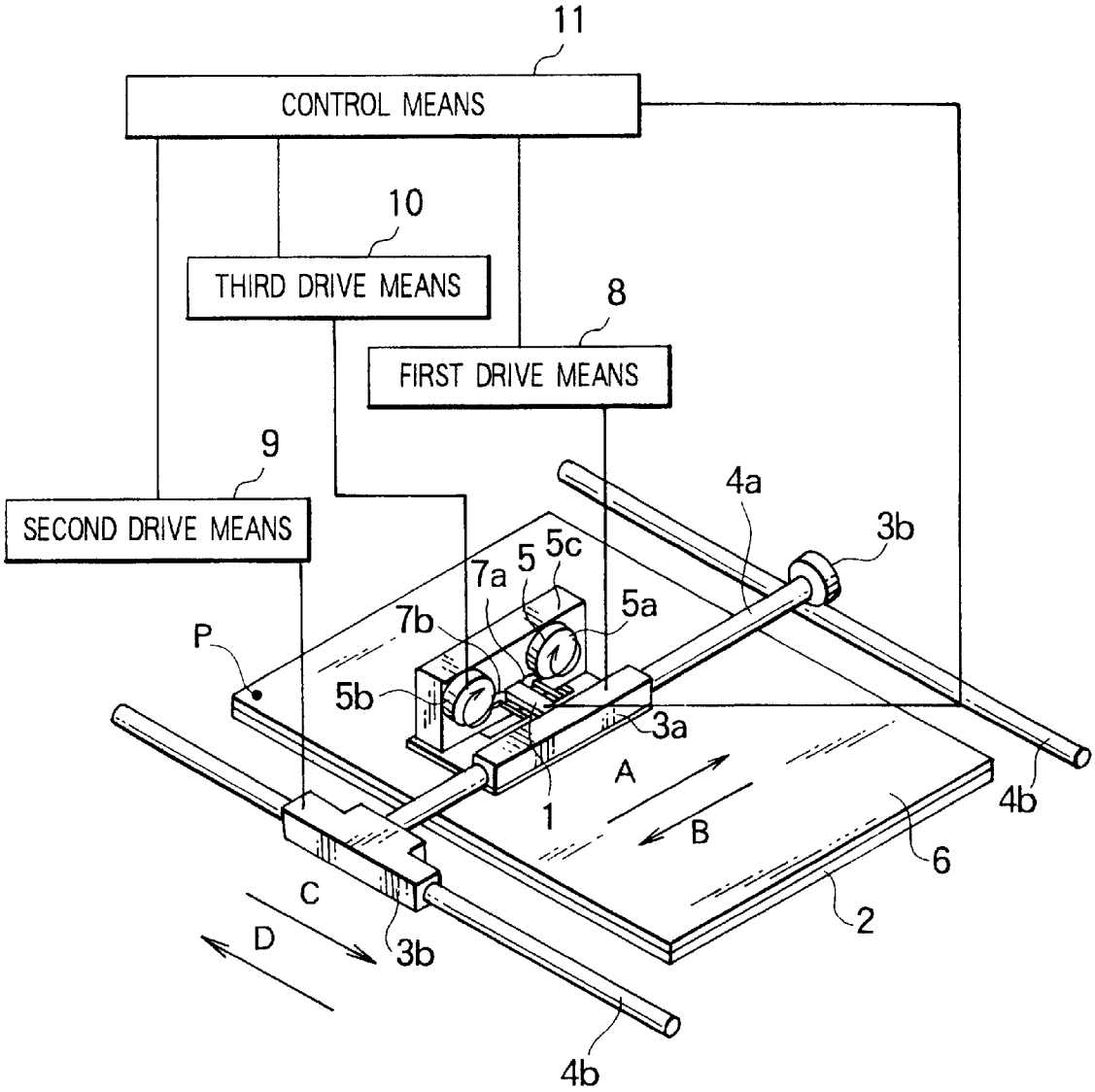
FIG. 1 is a drawing showing the constitution of the thermal recording apparatus according to the embodiment 1 of the present invention.

The thermal recording apparatus according to the embodiment 1 of the present invention shall be explained below with reference to the drawings. FIG. 1 is a structural drawing showing one example of the thermal recording apparatus according to the embodiment 1. In FIG. 1, 1 is a recording head and has three recording elements at an interval of 2 dots in a sub-scanning direction as shall be described later; 2 is a platen and is composed of a material such as rubber and metal; 3*a*, 3*b* are carriages, wherein the recording head 1 described above and a recording medium 5 stored in a cassette 5*c* are loaded in 3*a*, and 3*b* is used when moving the above recording head 1 and the above recording medium 5 in the sub-scanning direction; 4*a* is a guide shaft in a main-scanning direction, and 4*b* a guide shaft in the sub-scanning direction; 5 is a recording medium, wherein an ink sheet provided thereon with a sublimate dye is wound on a feed roll 5*a* and a winding roll 5*b*; 6 is a recorded medium and fed on the platen 2 by means of a recorded medium-transporting means (not shown); 7*a*, 7*b* are guide rollers; 8 is a first drive means for driving the recording head 1 described above in the main-scanning direction; 9 is a second drive means for driving the recording head 1 at a distance of 3 dots every sub-scanning in the sub-scanning direction; 10 is a third drive means for driving the recording medium 5 disposed so that it contacts the recorded medium 6 described above; and 11 is a control means for controlling the first drive means 8, the second drive means 9 and the third drive means 10 and outputting image data to be recorded on the recorded medium 6 to the recording head 1 described above.

Figure 2:
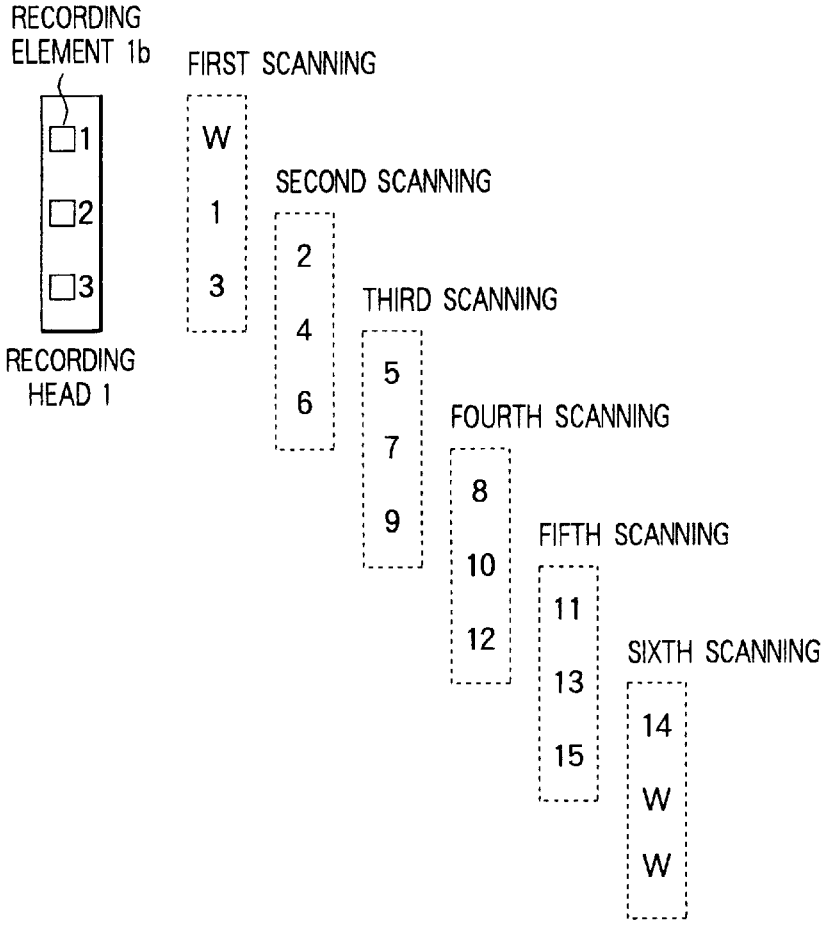
FIG. 2 is a drawing for explaining the driving way of the recording head 1 according to the embodiment 1 of the present invention.
Figure 3:
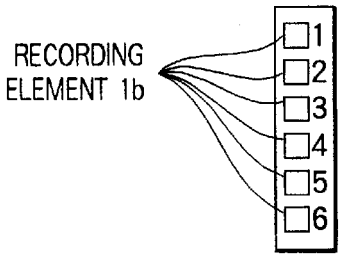
FIG. 3 is a drawing showing another constitution of the recording head 1 according to the embodiment 1 of the present invention.
Figure 4:
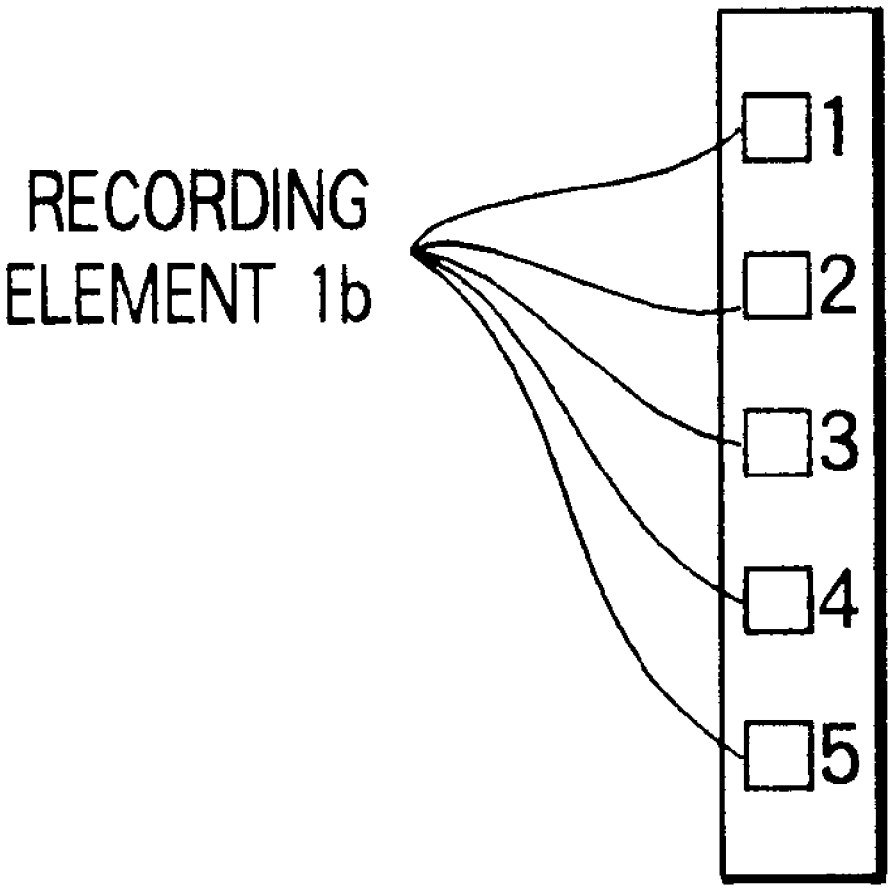
FIG. 4 is a drawing showing still another constitution of the recording head 1 according to the embodiment 1 of the present invention.

Before explaining the operation of embodiment 1 shown in FIG. 1, a method for driving the recording head 1 which is the characteristic of the present invention shall be explained using FIGS. 2 to 4. FIG. 2 is a chart for explaining the driving operation of the recording head 1 and shows an example in which 1*b* is a recording element comprising a thermal resistor and three elements are disposed at a two dot pitch (two dot interval) in the sub-scanning direction. This recording head is used to record image data according to the following procedure. That is, in the first main-scanning, dots corresponding to a white line (W), the first line and the third line are recorded in order in the width of the main-scanning by means of the first, second and third recording elements 1*b*, wherein the white line (W) corresponds to a blank part other than the image data, and an equation (1) which shall be described later has to be satisfied in order to equalize pitch feeds in the sub-scanning direction. When pitch feed is carried out according to the equation (1) described later, the recording operation has to start from the second recording element 1*b*. Next, the recording head 1 is moved relative to the recorded medium 6 by 3 dots (3 pitches) in the sub-scanning direction (lower direction in the drawing). In the second main-scanning, dots corresponding to the second line, the fourth line and the sixth line are recorded in order by means of the first, second and third recording elements 1*b*. Hereinafter, the same operation is repeated, whereby the dots are formed on the different main-scanning lines (recording lines), and the image data of 15 lines can be obtained by six main-scannings. In FIG. 2, white dots are allotted to the second and third recording elements 1*b* in the sixth main-scanning, and white lines are allotted to blank parts other than the image data following the sixteenth line.

FIG. 3 is a structural drawing of the recording head provided with continuous six recording elements 1*b*. In the case of such a recording head, if the first, third and fifth recording elements 1*b* are made effective, and white dots are allocated to the second, fourth and sixth recording elements 1*b*, the recording head described above becomes equivalent to the recording head 1 having three recording elements at an interval of 2 dots shown in FIG. 2. Inversely, white dots may be allotted to the first, third and fifth recording elements 1*b*, and the second, fourth and sixth recording elements 1*b* may be made effective. Thus, a recording head usually used can be used as it is by making the recording elements selectively effective. Further, also in the case where 64 pieces of the recording elements 1*b* are continuously disposed, such a recording head becomes equivalent to the recording head 1 having three recording elements at an interval of 2 dots shown in FIG. 2, if, for example, only the first, third and fifth recording elements 1*b* are made effective, and white dots are allocated to the remaining recording elements 1*b*. In such manner as described above, a recording head having 64 continuous recording elements which is generally used for a printer head in a word processor can be used as it is.

In the drive method described above, recording is carried out in order on non-recorded (vacant) parts in the sub-scanning direction. To be specific, in the case where n pieces of the recording elements are disposed at an interval of k dots, only p pieces of the recording elements are made effective and used, and after one main-scanning, the recording head 1 is driven by a distance of p dots in the sub-scanning direction, wherein the following relation is present between k, n and p:

$$p=k\times a\pm 1\leqq n \tag{1}$$

wherein a is a positive integer, and p and k are positive integers which become prime to each other. For example, in the example of FIG. 2, sub-scanning drive of 3 dot pitch (p=2×1+1) shall be carried out using the head having 3 pieces (n=3) of the recording elements at an interval of 2 dots (k=2). In this case, the number p of the recording elements which are effective is equal to the number p of the dots present at a driven distance in the sub-scanning direction, and therefore it is 3. FIG. 4 is a structural drawing of the recording head provided with 5 pieces (n) of the recording elements 1*b* at an interval of 3 dots (k). In this case, sub-scanning drive of 5 dot pitch (p=3×2−1) is suitably carried out. When only 4 pieces of the recording elements 1*b* are made effective in the recording head shown in FIG. 4, sub-scanning drive of 4 dot pitch (p=3×1+1) is carried out.

If the driving method according to the equation (1) described above is used, the pitch feed amount in the sub-scanning direction can be equalized, and high quality printing having no banding can be achieved as well in an inexpensive apparatus. This is because an accuracy error in the mechanism and unevenness in temperature distribution are dispersed in the picture plane by carrying out printing dispersing the main-scanning lines, and an apparent degradation in the image quality is suppressed. Particularly in the case of a thermal recording apparatus, an interval between the adjacent recording elements can be broadened, and as a result thereof, the effect that a thermal influence exerted from the adjacent recording elements can be relaxed is provided. Further, also when the recording medium 5 is used many times to carry out recording, the used parts in the recording medium can be dispersed, and therefore the number of repetitive uses can relatively be increased. Further, when using a relative speed method of a recording medium and a recorded medium, the amount of ink use is dispersive, and therefore ink movement (charging) in the recording medium can efficiently be carried out. In addition, a concentration drift caused by accumulated heat can apparently be improved as well in two way printing as compared with one way printing.

Next, the operations of embodiment shall be explained. First, the recorded medium 6 is set on the platen 2 by means of a recorded medium-transporting means (not shown) or manual operation. The platen 2 is a flat metal or a rubber-like material. The whole edge, both ends or one end of the recorded medium is fixed on the platen 2 by means of a roller or a damper (not shown). The recording head 1 is loaded in the carriage 3*a*, and the carriage 3*a* is reciprocatively driven along the guide shaft 4*a* by means of the drive means 8. Specifically, when the recording head 1 is driven in the direction of arrow A, recording is carried out, and after the recording head 1 is returned in an arrow B direction, the recording head 1 is driven by means of the second drive means 9 in a direction (arrow C direction) in which the recording head 1 is moved relatively to the recorded medium 6 by a distance of 3 dots (p dots) in the sub-scanning direction, and then the next main-scanning is carried out.

Figure 5:
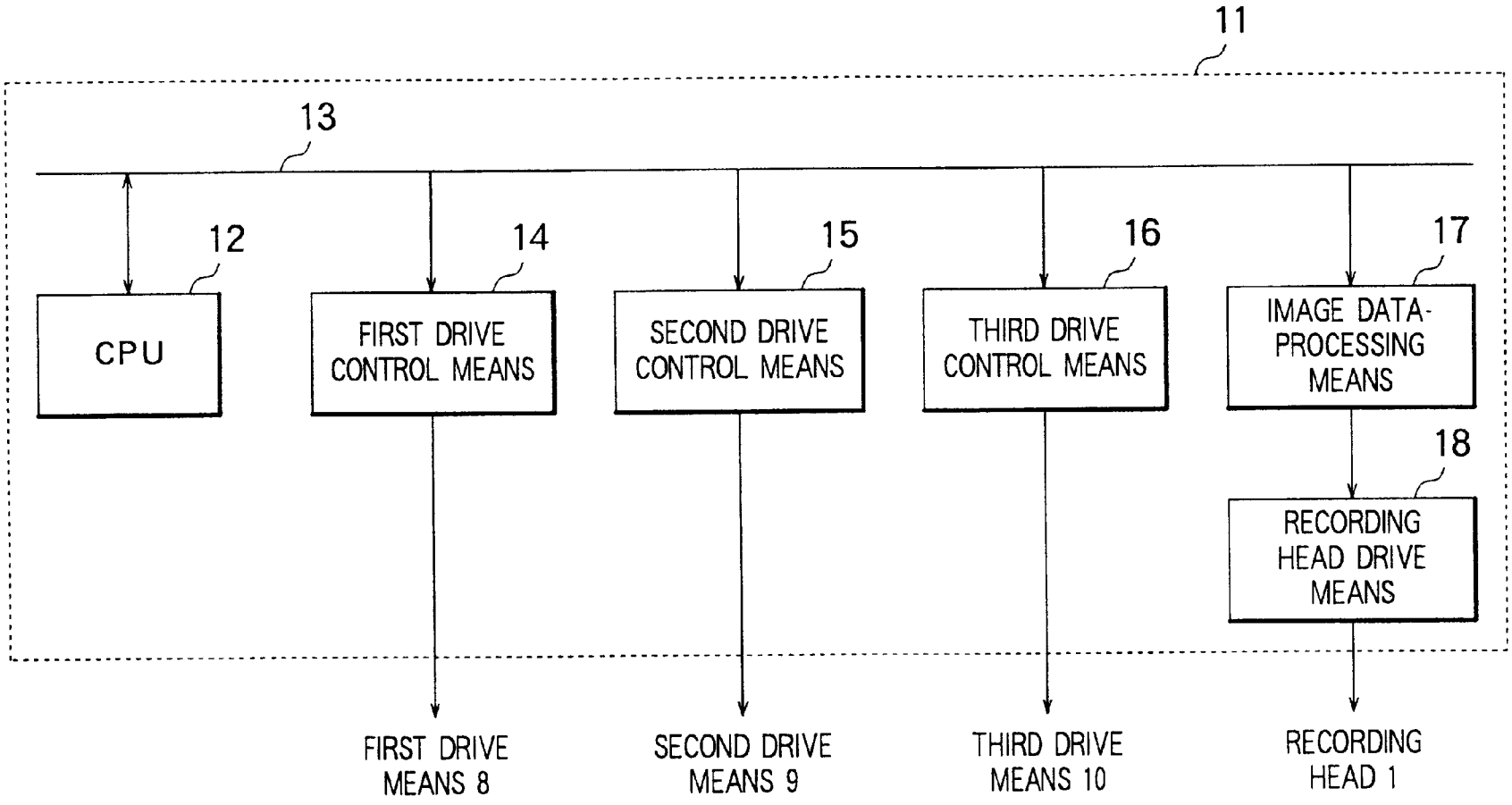
FIG. 5 is a structural chart for the control means 11 according to the embodiment 1 of the present invention.

An image data formed in the control means 11 is input into the recording head 1, and intended recording is carried out on the recorded medium 6 via the recording medium 5. The control means 11 is composed of, for example, a CPU 12, a control bus 13, a first drive control means 14, a second drive control means 15, a third drive control means 16, an image data-processing means 17 and a recording head drive means 18, as shown in FIG. 5.

Image data is input from an external means (not shown) is, for example, a computer and the like through the control bus 13, and then, as shown in FIG. 2, the image data-processing means 17 processes the image data so that dots corresponding to a white line, the first line and the third line are recorded in the width of the main-scanning by means of the first, second and third recording elements 1*b* in the first main-scanning, and dots corresponding to the second line, the fourth line and the sixth line are recorded by means of the first, second and third recording elements 1*b* in the second main-scanning. Specifically, the image data-processing means 17 processes the input image data on a hardware (H/W) or a firmware (F/W) to form an image data according to a drive method of the recording head 1. An output data from the image data-processing means 17 is input into the recording head drive means 18. In the recording head drive means 18, the drive conditions of the recording head 1 are effected (for example, the image data is converted to anelectric pulse) to carry out recording. The CPU 12 drives the first drive means 8, the second drive means 9 and the third drive means 10 as shown in FIG. 2 by actuating the first drive control means 14, the second drive control means 15 and the third drive control means 16 through the control bus 13 according to a sequence determined in advance.

The specific schematic sequence is as follows. The recording medium 5 is set on the carriage 3*a*, and the carriage 3*a* resides in a home position state shown by P in FIG. 1.

(1) The recorded medium 6 is set on the platen 2 by a recorded medium-transporting means (not shown) or manual operation. The recorded medium 6 is fixed on the platen 2, if necessary, by means of a clamper, a roller, electrostatic adsorption and a tape which are not illustrated.

(2) The CPU 12 receives a command of "record" from an external apparatus which is not illustrated, for example, a host computer and the like through the control bus 13, and then an image data is first subjected to data processing as shown in FIG. 2 by means of the image data-processing means 17 in the first main-scanning. Next, the image data is converted to an electric pulse and the like by means of the recording head drive means 18 and sent in order to the recording head 1. The CPU 12 drives the carriage 3*a* loaded with the recording head 1 and the recording medium 5 by means of the first drive means 8 and the third drive means 10. To be specific, in recording in the main-scanning direction, the carriage 3*a* loaded with the recording head 1 is driven in the arrow A direction by means of the first drive means 8 so that recording is carried out at an intended resolution, and the recording medium 5 is wound on the winding roll 5*b* from the feed roll 5*a* through the lower part of the recording head 1 at approximately the same speed as the moving speed of the recording head 1 by means of the third drive means 10 so that the recording medium 5 is not loosened and torn off. The first drive means 8 and the third drive means 10 are composed of, for example, motors and the like, wherein intended operations are carried out with the voltages or drive pulse signals of the first drive control means 14 and the third drive control means 16 which are controlled by the CPU 12. The applying timing of an electric pulse and the like to the recording head 1 is roughly synchronized with the drive timings of the first drive means 8 and the third drive means 10, and the recording medium 5 and the recording head 1 are driven while carrying out recording.

(3) After finishing the first main-scanning, the second main-scanning is prepared. A method for preparing the next main-scanning includes, for example, the following three ones:

(a) At a position slightly passing through a position where the first main-scanning is finished, the carriage 3*a* is moved by a distance of a prescribed dot number (in this example, 3 dots) in the sub-scanning direction by means of the second drive means 9. To be specific, the CPU 12 gives a drive pulse to the second drive means 9 which is composed of a motor and the like to move the carriage 3*b* in the arrow C direction. Then, the carriage 3*a* is moved in the arrow B direction by means of the first drive means 8 and returned to a position slightly this side from a record-starting position.

(b) The carriage 3*a* is returned in the arrow B direction as it is, and then at a position slightly this side from the record-starting position, the carriage 3*a* is moved by a distance of a prescribed dot number (in this example, 3 dots) in the sub-scanning direction by means of the second drive means 9.

(c) Both the first drive means 8 and the second drive means 9 are used to return obliquely the carriage 3*a* to a position slightly this side from the record-starting position in the arrow B direction.

(4) The same main-scanning recording and sub-scanning feed as in the items (2) and (3) described above are carried out to form an image.

(5) After forming the image, both the first drive means 8 and the second drive means 9 are used to move the carriage 3*a* to the start position P.

(6) The recorded medium 6 is detached from the platen 2 by means of an unillustrated recorded medium transporting means or manual operation.

The constitution described above provides the effect that high quality recording having no stripes between the main-scannings can be achieved at a low cost. Further, the plate-shaped platen 2 is used, and therefore the apparatus can be thinned.

In this embodiment, an example in which the recording head 1 has a recording element number of 3, a recording element interval of 2 and a recording head feed pitch of 3 is picked up. These values may satisfy the relation of the equation (1) and shall not specifically be restricted. Further, also when the recording head 1 having the continuous recording elements 1*b* is used, an effective recording element number (p) can be substituted for the recording element number, and an effective recording element interval (k) can be substituted for the recording element interval. The same effect is provided. In this case, a conventional recording head can be used as well.

In the example described above, an example in which the recording head 1 is fixed has been described. However, a drive means may be provided, if necessary, so that the recording head goes up and down. For example, employed is the constitution in which the recording head 1 is pressed to the recorded medium 6 in main-scanning recording and is not pressed in the other cases, wherein the recording head 1 remains apart from the recording medium 5 in non-recording to prevent the recording medium 5 from being torn off by movement of the recording head 1.

In the present invention, various variations other than the embodiment described above are possible. For example, the image data-processing means 17 may be substituted with an unillustrated external means, for example, a printer driver of a computer to input an image data obtained after processing into the recording head drive means 18. A half tone image corresponding to a multivalent image data may be formed. Further, the feeding roll 5*a* (feed reel) may be braked with the third drive means 10 to give a tension to the recording medium 5 to control the recording medium 5 so that the creases of the recording medium 5 which become a factor for a degradation in the image quality are removed. In addition, the feed speed of the recording medium 5 is set different from the drive speed of the recording head 1, and the drive speed of the recording head 1 is set larger, whereby the recording medium 5 is less consumed, and the running cost can be reduced.

The platen 2 has been set to almost the same size as that of the recorded medium 6. However, it may be as small as the recording size of the recorded medium 6 or may be larger than the recorded medium 6. Further, if the platen 2 is made of rubber, expected is the effect that the platen 2 plays a role of cushion against the recorded medium 6, which makes it possible to carry out high quality recording. The thickness thereof shall not be restricted.

The guide rollers 7*a*,7*b* may be omitted if no creases are produced on the recording medium 5. Further, various modifications are possible on the shape of the carriages 3*a*,3*b*.

Embodiment 2

Figure 6:
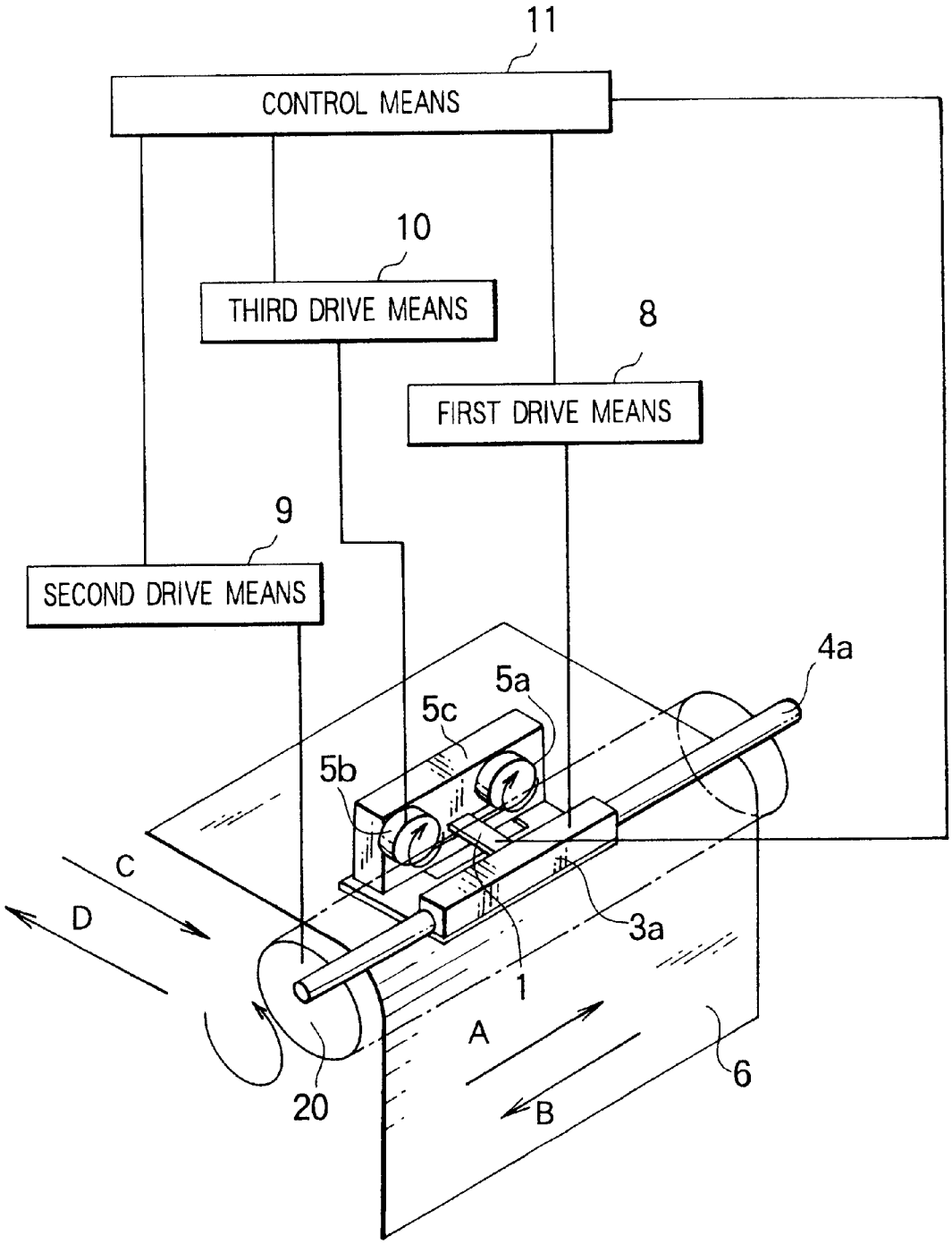
FIG. 6 is a drawing showing the constitution of the thermal recording apparatus according to the embodiment 2 of the present invention.

The thermal recording apparatus according to the embodiment 2 shall be explained below with reference to FIG. 6. FIG. 6 is a structural drawing showing the thermal recording apparatus in the embodiment 2. In the drawing, the same symbols as in FIG. 1 show the same or corresponding parts, and therefore the explanations thereof shall be omitted. The numeral 20 is a platen roller which is cylindrically composed of a material such as rubber and metal, and sub-scanning feed of a recorded medium 6 is carried out by friction between the platen roller 20 and a recorded medium 6 by means of a second drive means 9. Differences from FIG. 1 resides in the point that a recording head 1 loaded in a carriage 3*a* and a recording medium 5 are not moved in a sub-scanning direction and the recorded medium 6 is moved in the sub-scanning direction.

Next, the operations shall be explained. First, the recorded medium 6 is set on the platen roller 20 by means of an unillustrated recorded medium-transporting means or manual operation. In this case, the recorded medium 6 may be subjected to sensing with an unillustrated sensor in order to clarify a record position on the recorded medium 6. The recording head 1 is loaded on the carriage 3*a*, and the carriage 3*a* is reciprocatively driven along a guide shaft 4*a* by means of a first drive means 8. To be specific, when the recording head 1 is driven in an arrow A direction, recording is carried out, and the recording head 1 is moved in an arrow B direction to return to a position slightly this side from a record-starting position. Then, after driving the platen roller 20 (recorded medium 6) in a direction in which the recording head 1 is moved relatively to the recorded medium 6 by a distance of 3 dots in the sub-scanning direction, the next main-scanning is carried out.

An image data formed in a control means 11 is input into the recording head 1, and intended recording is carried out on the recorded medium 6 via the recording medium 5. The control means 11 is of, for example, a constitution shown in FIG. 5. A difference from FIG. 1 resides in a sequence of the second drive means 9, and hereinafter, the explanation shall be restricted to the sequence described above.

First, the recorded medium 6 is set on the platen roller 20 by means of recorded medium-transporting means (not shown) or manual operation. A command of "record" is received from an unillustrated external apparatus, and then image data are first recorded in order in the first main-scanning. To be specific, in recording in a main-scanning direction, the carriage 3*a* loaded with the recording head 1 is driven in an arrow A direction by means of the first drive means 8 so that recording is carried out at an intended resolution, and the recording medium 5 is wound on a winding roll 5*b* from a feed roll 5*a* through the lower part of the recording head 1 at approximately the same speed as the moving speed of the recording head 1 by means of the third drive means 10 so that the recording medium 5 is not loosened and torn off.

The first main-scanning is finished, and then the second main-scanning is prepared. A method for preparing the next main-scanning includes the following three steps:

(a) At a position slightly passing through a position where the first main-scanning is finished, the platen roller 20 is turned by means of the second drive means 9 to move the recorded medium 6 by a distance of a prescribed dot number (in this example, 3 dots) in the sub-scanning direction. To be specific, the control means 11 gives a drive pulse to the second drive means 9 composed of a motor and the like to turn the platen roller 20 to move the recorded medium 6 in the arrow D direction. Then, the carriage 3*a* is moved in the arrow B direction by means of the first drive means 8 and returned to a position slightly this side from the record-starting position.

(b) The carriage 3*a* is returned in the arrow B direction as it is, and then at a position slightly this side from a record-starting position, the platen roller 20 is turned by means of the second drive means 9 to move the recoded medium 6 by a distance of a prescribed dot number (in this example, 3 dots) in the sub-scanning direction.

(c) Both the first drive means 8 and the second drive means 9 are used to return the carriage 3*a* to a position slightly this side from a record-starting position (resulting in oblique movement) in the arrow B direction.

Thus, the main-scanning recording by driving the carriage 3*a* and the sub-scanning feed by driving the platen roller 20 are repeated to form an image.

The constitution as described above provides the effects that high quality recording having no stripes between the main-scannings can be achieved at a low cost and the apparatus having a small installation area can be obtained.

Also in this embodiment, various modifications are possible as is the case with the embodiment 1. For example, the recording head 1 is provided, if necessary, with an up and down mechanism to keep the recording head 1 apart from the recording medium 5 in non-recording, whereby the recording medium 5 can be prevented from being torn off by movement of the recording head 1. The size and the material of the platen roller 20 shall by no means be restricted.

Further, the platen 2 shown in FIG. 1 may be made cylindrical and formed a little larger in length than the width of the recording head 1 to be disposed oppositely to the recording head 1 via the recording medium 5 and the recorded medium 6; and this platen 2 may be moved in the same direction at the same time as the recording head 1. In this case, the recorded medium 6 is suitably fixed by some means so that it stands still.

The width of the platen roller 20 shall not be restricted as well, and it may be the width of the recording head 1 or larger than the width of the recorded medium 6. Thus, the embodiment 2 can be combined with the embodiment 1.

In addition, the sub-scanning feed of the recorded medium 6 may be carried out by a damper method in which the recorded medium 6 is transported by clamping the end thereof, instead of driving the platen roller 20.

Embodiment 3

Figure 7:
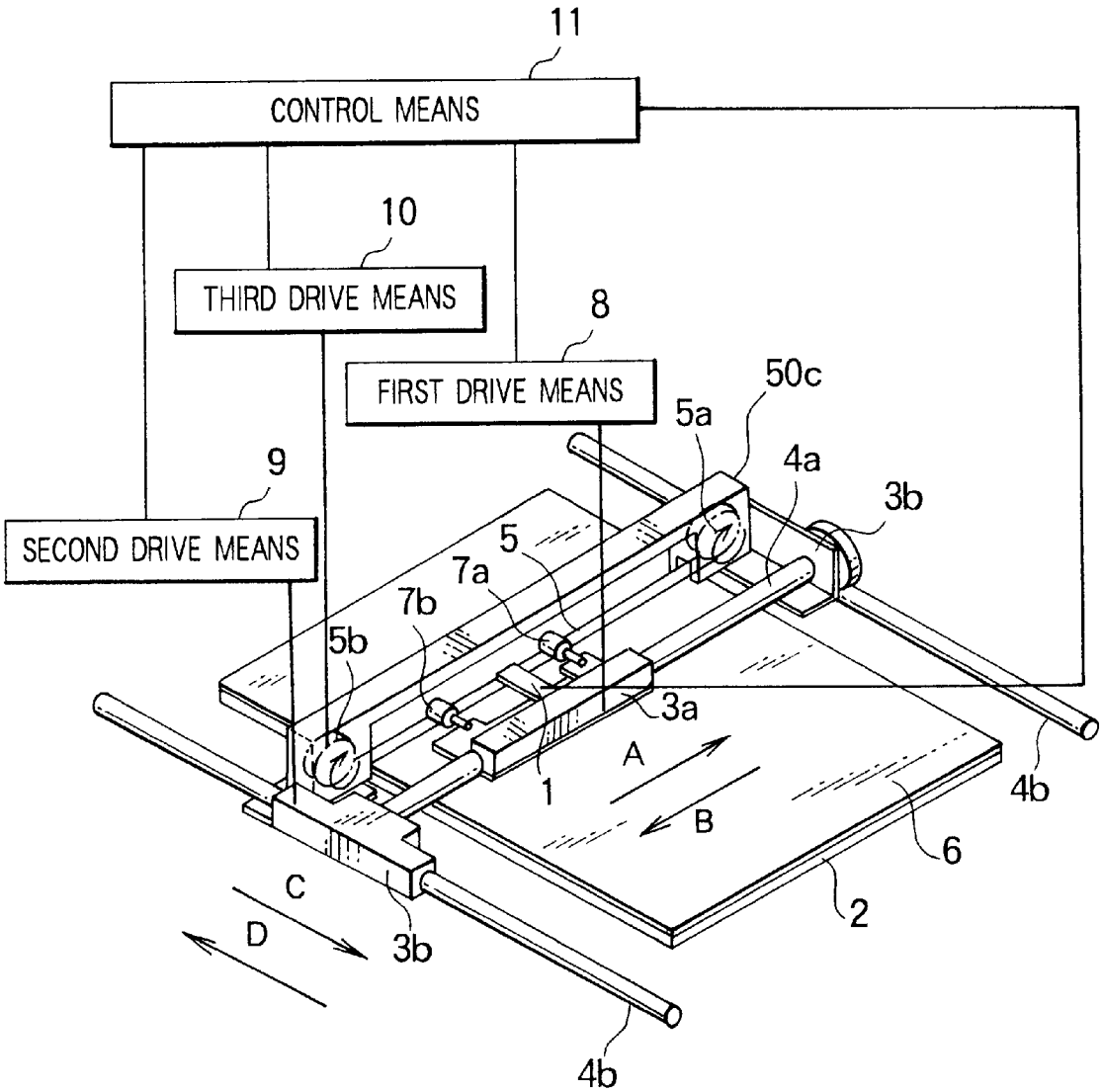
FIG. 7 is a drawing showing the constitution of the thermal recording apparatus according to the embodiment 3 of the present invention.

A thermal recording apparatus according to the embodiment 3 shall be explained below with reference to the drawing. FIG. 7 is a structural drawing showing the thermal recording apparatus in the embodiment 3. In the drawing, the same symbols as in FIG. 1 show the same or corresponding parts, and therefore the explanations thereof shall be omitted. The numeral 5 is a recording medium; 5*a* is a feed roll; 5*b* is a winding roll; and 50*c* is a cassette for storing a recording medium 5. A difference from FIG. 1 resides in the point that the width of the cassette 50*c* for storing the recording medium 5 is approximately equal to the width of a recorded medium 6. To be specific, it is longer than the maximum recording width in the recorded medium 6. A control means 11 drives a first drive means 8 and a third drive means 10 at different time.

The operations in this embodiment shall be explained with reference to FIG. 7. First, the recorded medium 6 is set on a platen 2 by means of recorded medium-transporting means (not shown) or manual operation. A recording head 1 is loaded in a carriage 3*a*, and the carriage 3*a* is reciprocatively driven along a guide shaft 4*a* by means of the first drive means 8. To be specific, when the recording head 1 is driven in an arrow A direction, recording is carried out, and the recording head 1 is moved in an arrow B direction to return to a position slightly this side from a record-starting position. Then, after the recording head 1 is driven by a distance of 3 dots in an arrow C direction by a second drive means 9, the next main-scanning is carried out.

An image data formed in the control means 11 is input into the recording head 1, and intended recording is carried out on the recorded medium 6 via the recording medium 5. The control means 11 is of, for example, a constitution shown in FIG. 5. A difference from FIG. 1 resides in a sequence of the third drive means 10, and hereinafter, the explanations shall be restricted to the sequence described above.

First, after setting the recorded medium 6 on the platen 2, a drive signal is sent from the control means 11 to the third drive means 10 so that the control means 11 drives the third drive means 10, and the recording medium 5 is set so that it covers a main-scanning line of the recorded medium 6. In this case, the recording medium 5 is set to a start position by sensing an unillustrated marker on the recording medium 5 or feeding a fixed amount thereof and set (held) to a state having no looseness. Then, if the control means 11 receives a command of "record" from an external host computer and the like, data processing as shown in FIG. 2 is carried out, and the data are recorded in order, wherein in recording in the main-scanning direction, the control means 11 drives the first drive means 8, and the carriage 3*a* loaded with the recording head 1 is driven in an arrow A direction by means of the first drive means 8 so that recording is carried out at an intended resolution. While the control means 11 drives the first drive means 8, the third drive means 10 is not in a driving condition and remains holding the recording medium 5. After finishing the first main-scanning, the carriage 3*a* is moved by a distance of a prescribed dot number (in this example, 3 dots) in a sub-scanning direction by means of the second drive means 9 and returned to a position slightly this side from a record-starting position by means of the first drive means 8. Next, a drive signal is sent from the control means 11 to the third drive means 10, and the recording medium 5 is set so that a new part thereof covers the recorded medium 6. In this case, the recording medium 5 is set to a start position by sensing an unillustrated marker on the recording medium 5 or feeding a fixed amount thereof and set (held) again to a state having no looseness. Then, main-scanning recording, sub-scanning feeding and driving of the recording medium 5 are repeated in the sa me manner to form images.

The constitution as described above provides the effects that high quality recording having no stripes between the main-scannings can be achieved at a low cost and that since the third drive means 10 is not operated at the same time as the first drive means 8, the power consumption is suppressed and as a result thereof, the power source can be small and inexpensive.

In this embodiment, the platen 2 has been set to almost the same size as that of the recorded medium 6. However, it may be as small as the recording size of the recorded medium 6 or may be larger than the recorded medium 6. Further, the thickness of the platen 2 shall not be restricted as is the case with the embodiment 1.

The guide rollers 7*a*, 7*b* may be omitted if no creases are produced on the recording medium 5. Further, there can be taken the constitution in which the third drive means 10 is connected as well to the feed roll 5*a* and brakes it to give a tension to the recording medium 5 to remove the creases of the recording medium 5 which become a factor for a degradation in the image quality. In addition, when returning the carriage 3*a* in an arrow B direction, the third drive means 10 and the first drive means 8 may be driven so that timing for applying a drive pulse to the third drive means 10 is not synchronized with that of the first drive means B. Further, timing for rewinding or setting the recording medium 5 by sensing a marker may be when the marker is positioned either at the right end or the left end of the recording medium 5, and it shall not specifically be restricted.

Figure 8:
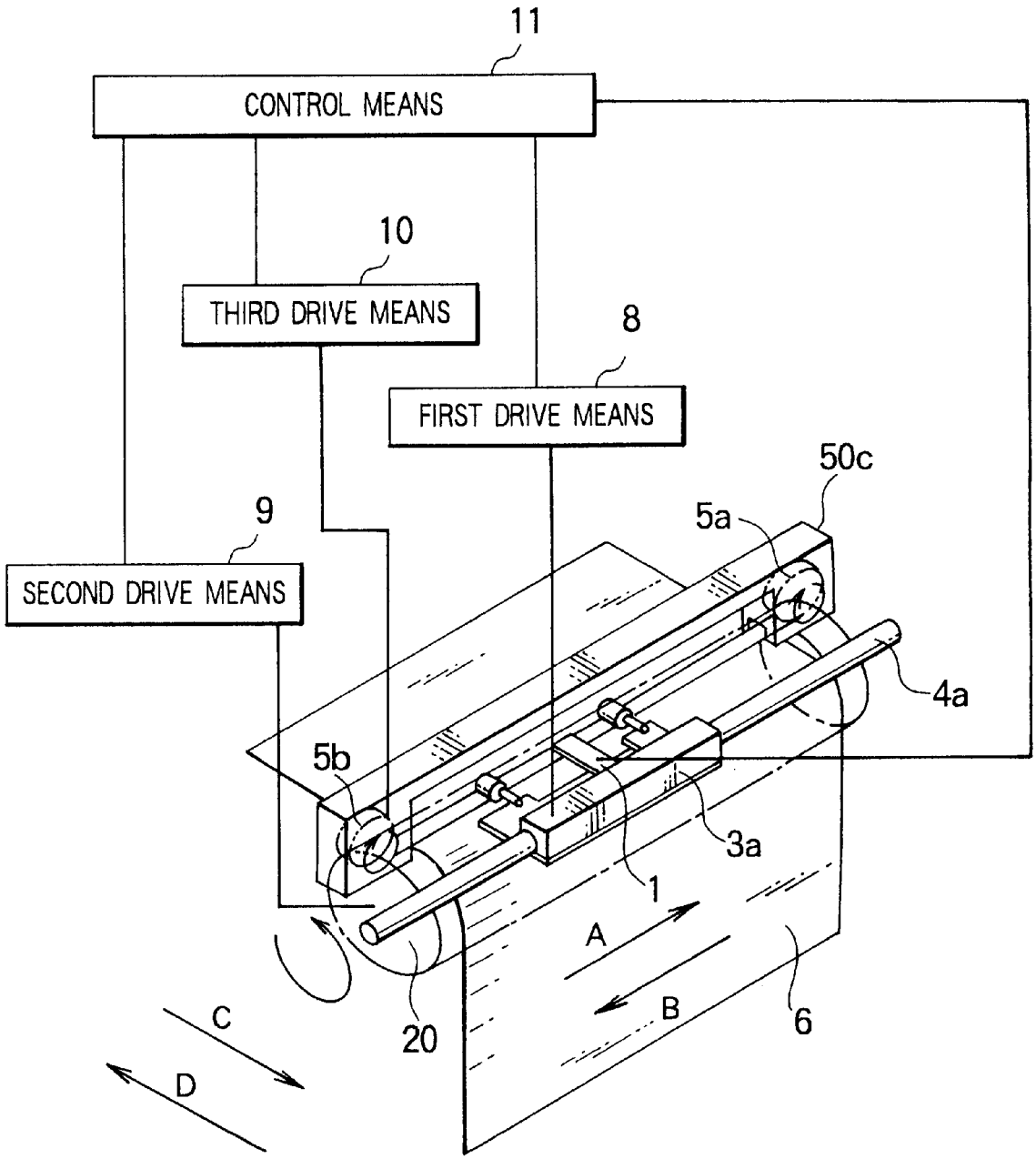
FIG. 8 is a drawing showing another constitution of the thermal recording apparatus according to the embodiment 3 of the present invention.

FIG. 8 is a structural drawing showing another thermal recording apparatus in this embodiment. A difference from FIG. 7 resides in the point that the recorded medium 6 is moved in the sub-scanning direction. FIG. 8 is constituted by combining FIG. 6 with FIG. 7, and provided are the effects that high quality recording having no stripes between the main-scannings can be achieved and the power consumption is suppressed and that the apparatus having a small installation area can be obtained.

Embodiment 4

Figure 9:
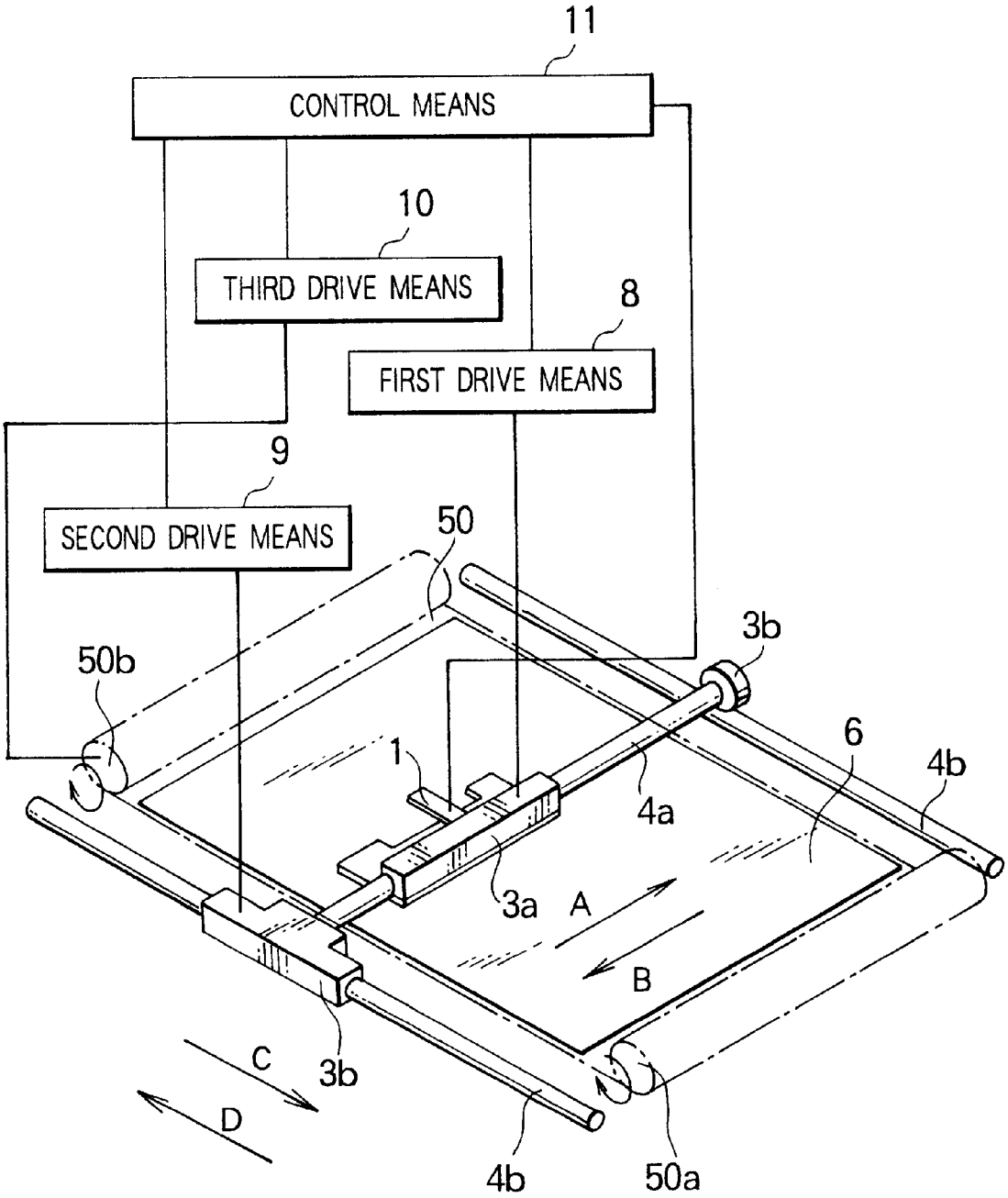
FIG. 9 is a drawing showing the constitution of the thermal recording apparatus according to the embodiment 4 of the present invention.

The thermal recording apparatus according to the embodiment 4 shall be explained below with reference to the drawing. FIG. 9 is a structural drawing showing the thermal recording apparatus in the embodiment 4. In the drawing, the same symbols as in FIG. 1 show the same or corresponding parts, and therefore the explanations thereof shall be omitted. The numeral 50 is a recording medium; 50*a* is a feed roll; and 50*b* is a winding roll. A difference from FIG. 1 resides in the point that the size of the recording medium 50 is approximately equal to that of a recorded medium 6. More specifically, a set of the record sections of the recording medium 50 is larger than the maximum recording size of the recorded medium 6. To be more detailed, in the thermal recording apparatus having a serial recording head, a low running cost has been achieved by using a line type recording medium instead of a conventional serial type recording medium. In general, a serial type recording medium is obtained by cutting a line type broad recording medium to process it into a narrow one. Since the steps of preparing a recording medium can be decreased by using a line type recording medium 50, the production cost of the recording medium can be reduced by 10 to 30%, and a low running cost can be achieved by using the inexpensive recording medium.

Also in the embodiment 4, a control means 11 drives the first drive means 8 and a third drive means 10 at different time as described later.

Next, the operations of embodiment 4 shall be explained. First, the recorded medium 6 is set on an unillustrated platen by means of an unillustrated recorded medium-transporting means or manual operation. A recording head 1 is loaded in a carriage 3*a*, and the carriage 3*a* is reciprocatively driven along a guide shaft 4*a* by means of the first drive means 8. To be specific, when the recording head 1 is driven in an arrow A direction, recording is carried out, and after finishing the recording by this main-scanning, the recording head 1 is moved in an arrow B direction to return to a position slightly this side from a record-starting position. Then, after the recording head 1 is driven by a distance of 3 dots in an arrow C direction by means of a second drive means 9, the next main-scanning is carried out.

An image data formed in a control means 11 is input into the recording head 1, and intended recording is carried out on the recorded medium 6 via the recording medium 50. The control means 11 is of, for example, a constitution shown in FIG. 5. A difference from FIG. 1 resides in a sequence of the third drive means 10, and hereinafter, the explanations shall be restricted to the sequence described above.

First, after setting the recorded medium 6 on the unillustrated platen, a drive signal is sent from the control means 11 to the third drive means 10, and the recording medium 50 is set so that it covers the whole part of the recorded medium 6. In this case, the recording medium 50 is set to a start position by sensing an unillustrated marker on the recording medium 50 or feeding a fixed amount thereof and set (held) to a state having no looseness. Then, if the control means 11 receives a command of "record" from an external host computer and the like, data processing as shown in FIG. 2 is carried out, and the data are recorded in order, wherein in recording in a main-scanning direction, the carriage 3*a* loaded with the recording head 1 is driven in an arrow A direction by means of the first drive means 8 so that the recording is carried out at an intended resolution. The third drive means 10 remains holding the recording medium 50. After finishing the first main-scanning, the carriage 3*a* is moved by a distance of a prescribed dot number (in this example, 3 dots) in a sub-scanning direction by means of the second drive means 9. Hereinafter, main-scanning recording and sub-scanning feeding are repeated in the same manner to form images.

The constitution as described above provides the effects that high quality recording having no stripes between the main-scannings can be achieved at a low cost and that since the size of the recording medium 50 is larger than a recording size, recording at a low running cost can be achieved by using the inexpensive line type recording medium.

In this embodiment, a platen roller is not specifically described and shall not specifically be restricted in size, material and surface constitution as long as it is of a plate form as is the case with the embodiment 1. Further, the platen may be of a roller form. It may be of, for example, a constitution in which a roller synchronized with the carriage 3*a* to move is provided on the back of the recorded medium 6 and partially contacted closely to the recording head 1. A roller or a pressing mechanism may be provided so that creases are not produced on the recording medium 50. Further, one end of a carriage 3*b* is of a roller form but shall not specifically be restricted, so that it may be of a structure using a screw, covering a guide shaft 4*b* or may be of a constitution to drive both ends thereof by means of the second drive means 9. In addition thereto, various modifications are possible as is the case with the embodiment 1, the embodiment 2 and the embodiment 3.

Figure 10:
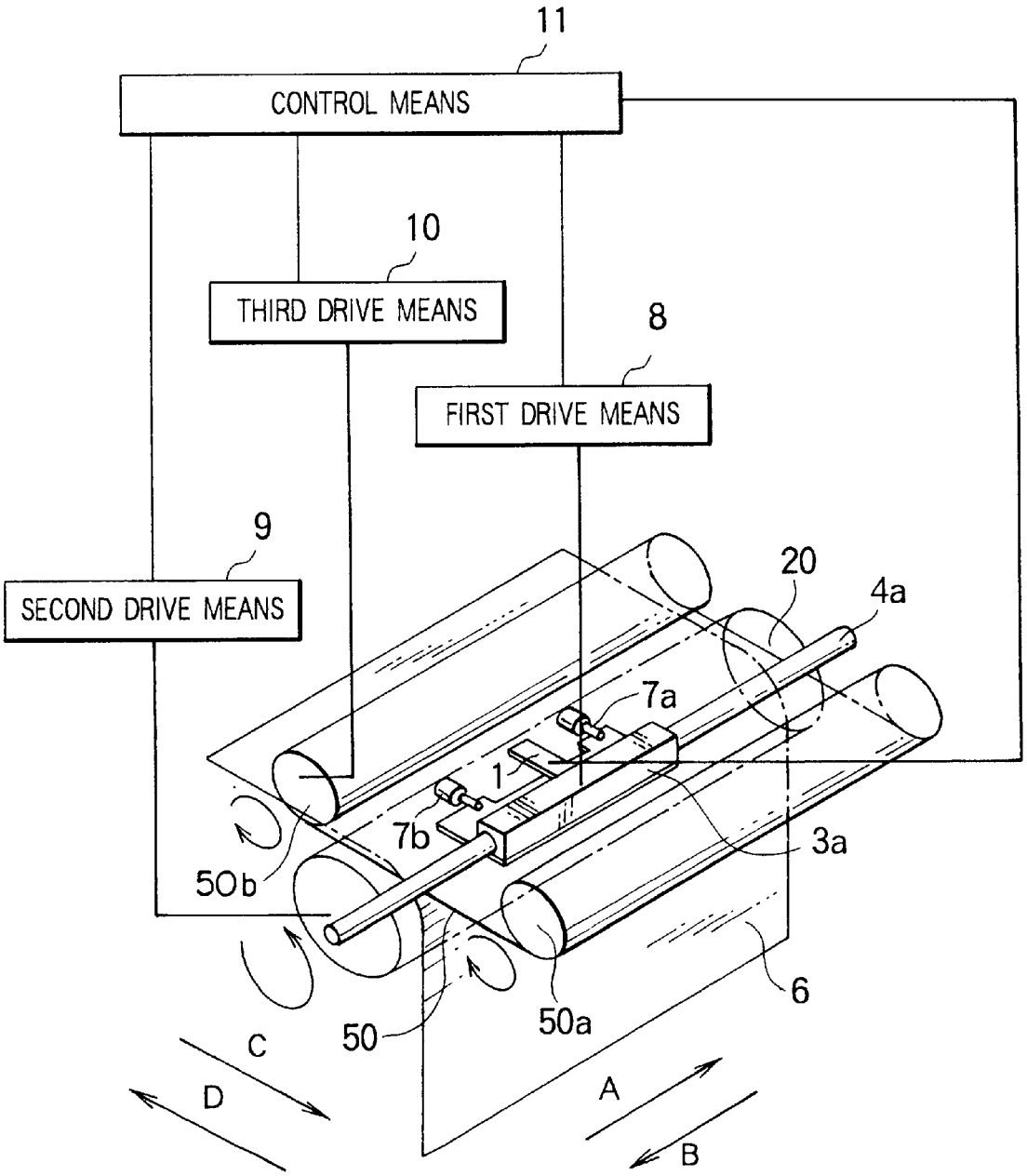
FIG. 10 is a drawing showing another constitution of the thermal recording apparatus according to the embodiment 4 of the present invention.

Next, FIG. 10 shall be used to explain another thermal recording apparatus in this embodiment. In the drawing, the same symbols as in FIG. 1 show the same or corresponding parts, and therefore the explanations thereof shall be omitted. A difference from FIG. 9 resides in the point that the recorded medium 6 is moved in a sub-scanning direction by means of a cylindrical platen roller 20.

Next, the operations shall be explained. First, the recorded medium 6 is set on the platen roller 20 by means of a recorded medium-transporting means (not shown) or manual operation. The recording head 1 is loaded on the carriage 3*a*, and the carriage 3*a* is reciprocatively driven along a guide shaft 4*a* by means of the first drive means 8. To be specific, when the recording head 1 is driven in the arrow A direction, recording is carried out, and after finishing the recording by this main-scanning, the recording head 1 is moved in the arrow B direction to return to a position slightly this side from a record-starting position. Then, after the platen roller 20 is turned by means of the second drive means 9 to move the recorded medium 6 by a distance of 3 dots in an arrow D direction, the next main-scanning is carried out.

An image data formed in the control means 11 is input into the recording head 1, and intended recording is carried out on the recorded medium 6 via the recording medium 50. The control means 11 is of, for example, a constitution shown in FIG. 5. A difference from FIG. 9 resides in a sequence of the third drive means 10, and hereinafter, the explanations shall be restricted to the sequence described above.

First, after setting the recorded medium 6 on the platen roller 20, a drive signal is sent from the control means 11 to the third drive means 10, and the recording medium 50 is set so that it covers the whole part of the recorded medium 6. In this case, the recording medium 50 is set to a start position by sensing an unillustrated marker on the recording medium 50 or feeding a fixed amount thereof and set (held) to a state having no looseness. Then, if the control means 11 receives a command of "record" from an external host computer and the like, data processing as shown in FIG. 2 is carried out, and the data are recorded in order, wherein in recording in a main-scanning direction, the carriage 3*a* loaded with the recording head 1 is driven in the arrow A direction by means of the first drive means 8 so that the recording is carried out at an intended resolution. The third drive means 10 remains holding the recording medium 50. After finishing the first main-scanning, the platen roller 20 is turned by means of the second drive means 9 to move the recorded medium 6 by a distance of a prescribed dot number (in this example, 3 dots) in the sub-scanning direction. Then, main-scanning recording and sub-scanning feeding are repeated in the same manner to form images.

The constitution as described above provides the effects that high quality recording having no stripes between main-scannings can be achieved at a low cost and that since the size of the recording medium 50 is larger than a recording size, recording at a low running cost can be achieved by using the inexpensive line type recording medium, and the apparatus having a small installation area can be achieved.

In this embodiment 4, guide rollers 7*a*, 7*b* are provided but may be omitted if no creases are produced on the recording medium 50. Further, the feed roll 50*a* may be driven as well by means of the third drive means 10, and the brake may be put on the feed roll 50*a* to give a tension to the recording medium 50 to remove the creases of the recording medium 50 which become a factor for a degradation in the image quality. Further, the platen roller 20 shall not be restricted as well in a size.

Embodiment 5

Figure 11:
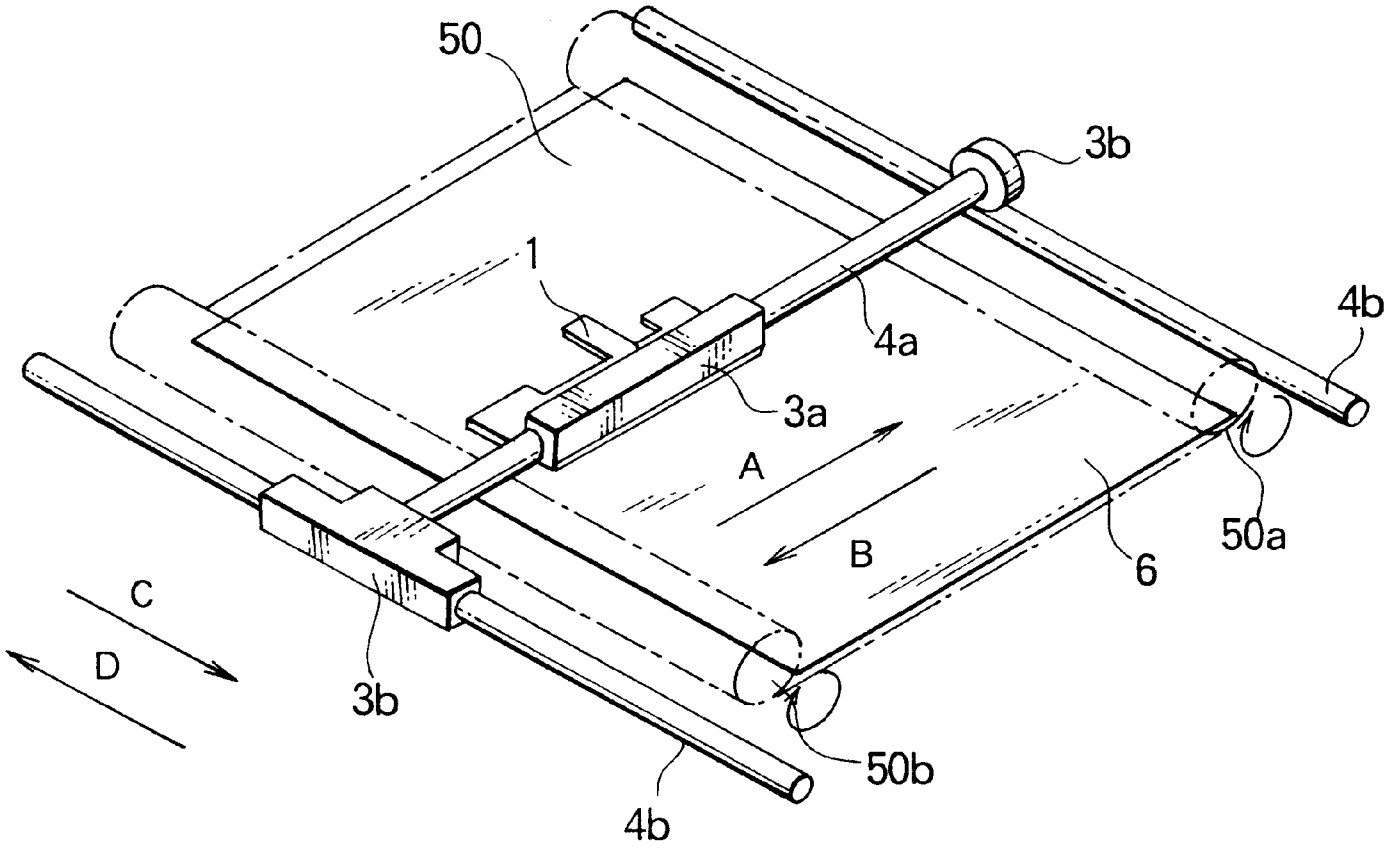
FIG. 11 is a drawing showing the constitution of the thermal recording apparatus according to the embodiment 5 of the present invention.

The thermal recording apparatus according to the embodiment 5 shall be explained below with reference to the drawing. FIG. 11 is a structural drawing showing the principal part of the thermal recording apparatus in the embodiment 5. In the drawing, the same symbols as in FIG. 9 show the same or corresponding parts, and therefore the explanations shall be omitted. The numeral 50 is a recording medium; 50*a* is a feed roll; and 50*b* is a winding roll. Differences from FIG. 9 resides in the points that the drive direction of the recording medium 50 is approximately the same as that of a recording head 1 and the moving direction of the recording medium 50 is reverse to a main-scanning direction. A first drive means 8, a second dive means 9, a third drive means 10 and a control means 11 have the same constitutions as in FIG. 9, and therefore the explanations shall be omitted.

Next, the operations of embodiment 5 shall be explained. First, a recorded medium 6 is set on a platen (not shown) by means of recorded medium-transporting means (not shown) or manual operation. A recording head 1 is loaded on a carriage 3*a*, and the carriage 3*a* is reciprocatively driven along a guide shaft 4*a*. To be specific, when the recording head 1 is driven in an arrow A direction, recording is carried out, and the recording head 1 is moved in an arrow B direction to return to a position slightly this side from a record-starting position. Then, after the recording head 1 is driven by a distance of 3 dots in an arrow C direction, the next main-scanning is carried out.

An image data is input into the recording head 1, and intended recording is carried out on the recorded medium 6 via the recording medium 50. A difference from FIG. 9 resides in a sequence of feeding and winding of the recording medium 50, and hereinafter, the explanations shall be restricted to the sequence described above.

First, after setting the recorded medium 6 on the unillustrated platen, the recording medium 50 is moved in a direction reverse to a main-scanning direction and set so that the recording medium 50 covers the whole part of the recorded medium 6. In this case, the recording medium 50 is set to a start position by sensing an unillustrated marker on the recording medium 50 or feeding a fixed amount thereof and set (held) to a state having no looseness. Then, data processing as shown in FIG. 2 is carried out, and the data are recorded in order, wherein in recording in a main-scanning direction, the carriage 3*a* loaded with the recording head 1 is driven in the arrow A direction so that the recording is carried out at an intended resolution. The recording medium 50 remains held. After finishing the first main-scanning, the carriage 3*a* is moved by a distance of a prescribed dot number (in this example, 3 dots) in a sub-scanning direction. Then, main-scanning recording and sub-scanning feeding are repeated in the same manner to form images.

The constitution as described above provides the effects that high quality recording having no stripes between the main-scannings can be achieved at a low cost and that since the size of the recording section of the recording medium 50 is larger than a recording size, recording at a low running cost can be achieved by using the inexpensive line type recording medium. Further, there is the effect that since a tension is given to the recording medium 50 in a direction reverse to the main-scanning direction, creases are less liable to be produced on the recording medium 50, and high quality recording can be stably obtained.

Figure 12:
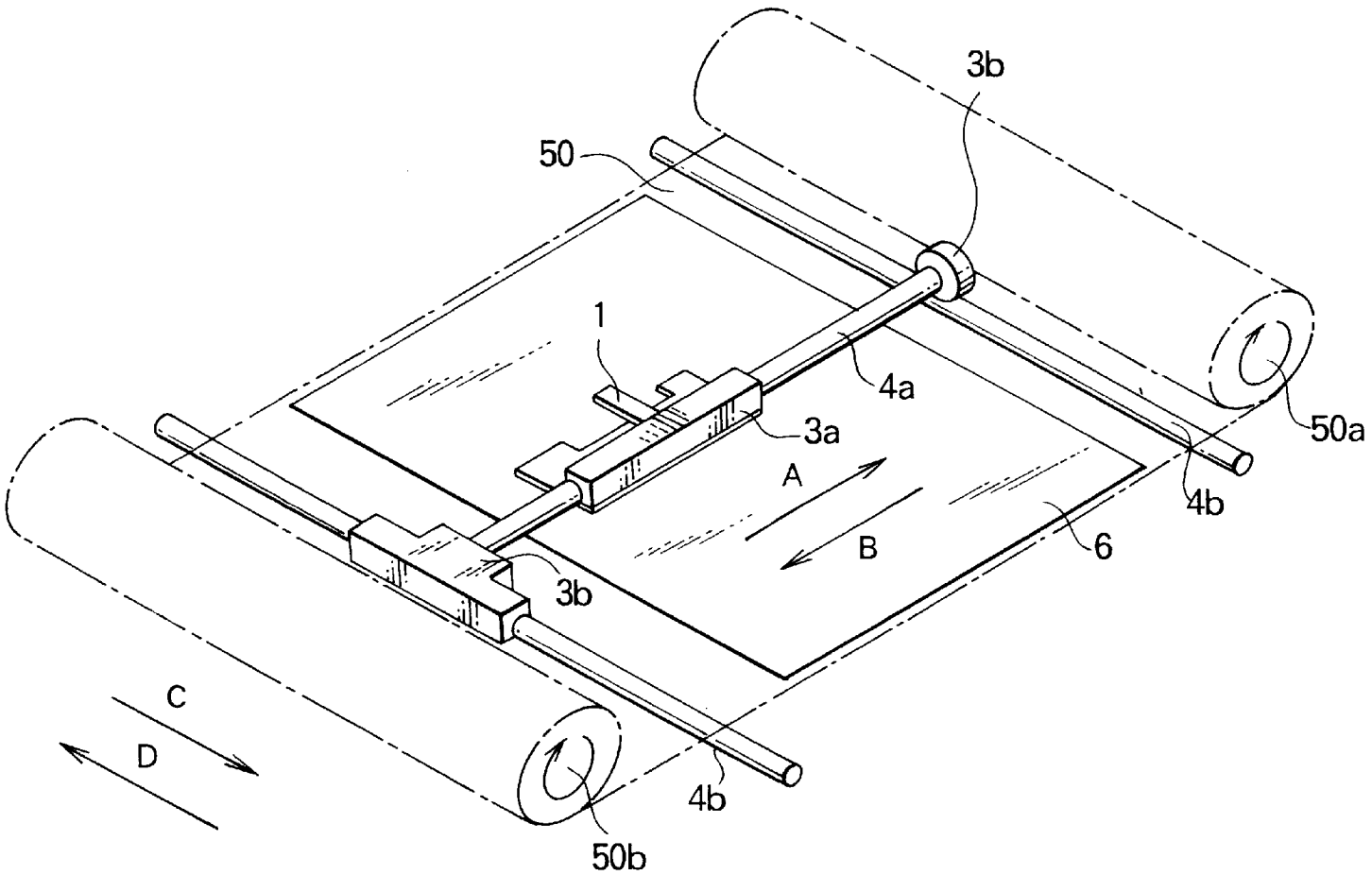
FIG. 12 is a drawing showing another constitution of the thermal recording apparatus according to the embodiment 5 of the present invention.

In this embodiment, the constitution is taken so that in the relation of the recording medium 50 with a guide shaft 4*b*, the recording medium 50 comes in the inside of the guide shaft 4*b* but may come in the outside thereof as shown in FIG. 12. Further, the constitution and the arrangement shall not specifically be restricted to the embodiments described above. There may be taken, for example, the constitution in which the feed roll 50*a* is driven by braking to give a tension to the recording medium 50 to remove the creases of the recording medium 50 which become a factor for a degradation in the image quality. Further, a start setting mechanism for the recording medium 50 may be provided.

Embodiment 6

Figure 13:
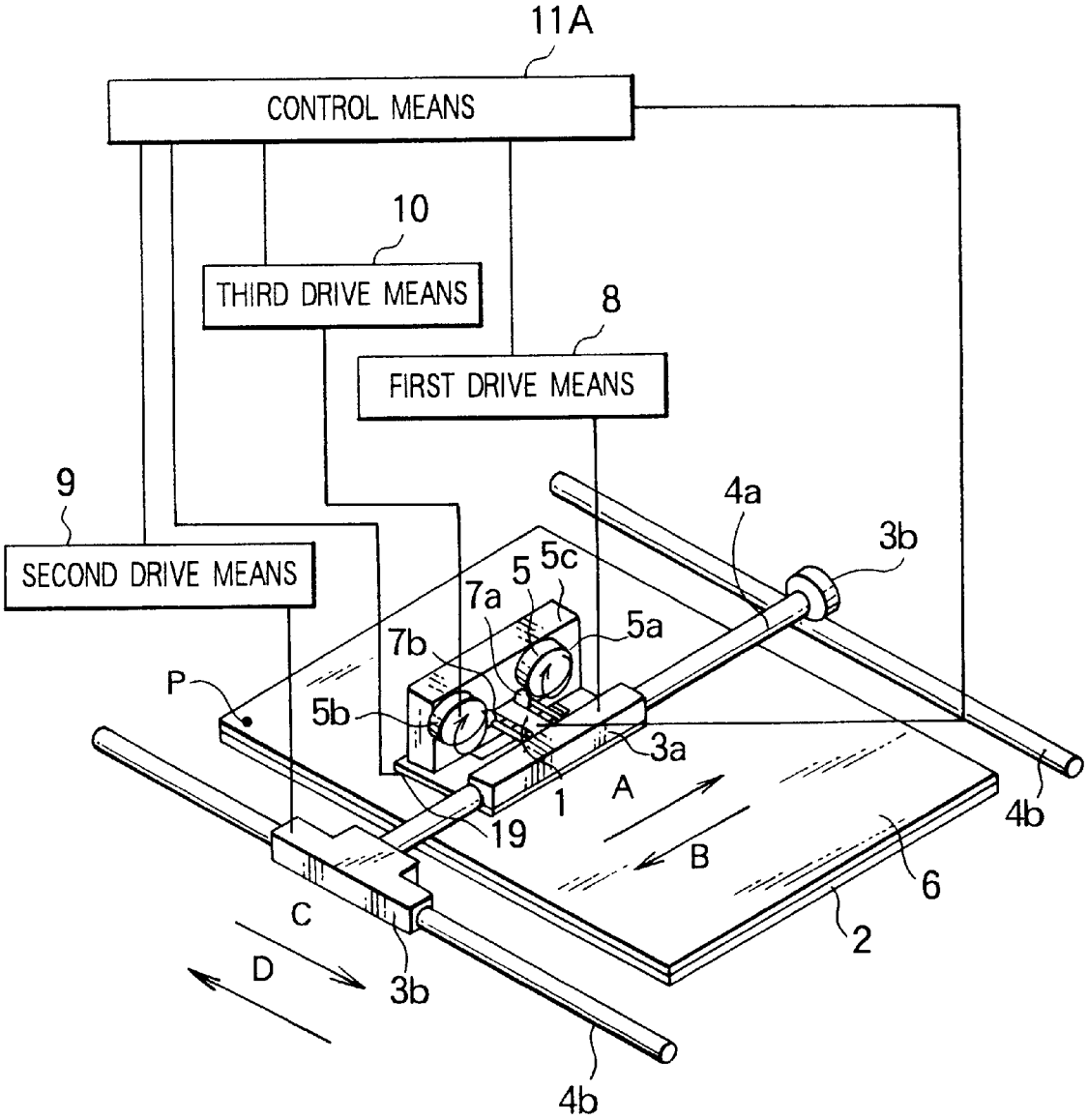
FIG. 13 is a drawing showing the constitution of the thermal recording apparatus according to the embodiment 6 of the present invention.
Figure 14:
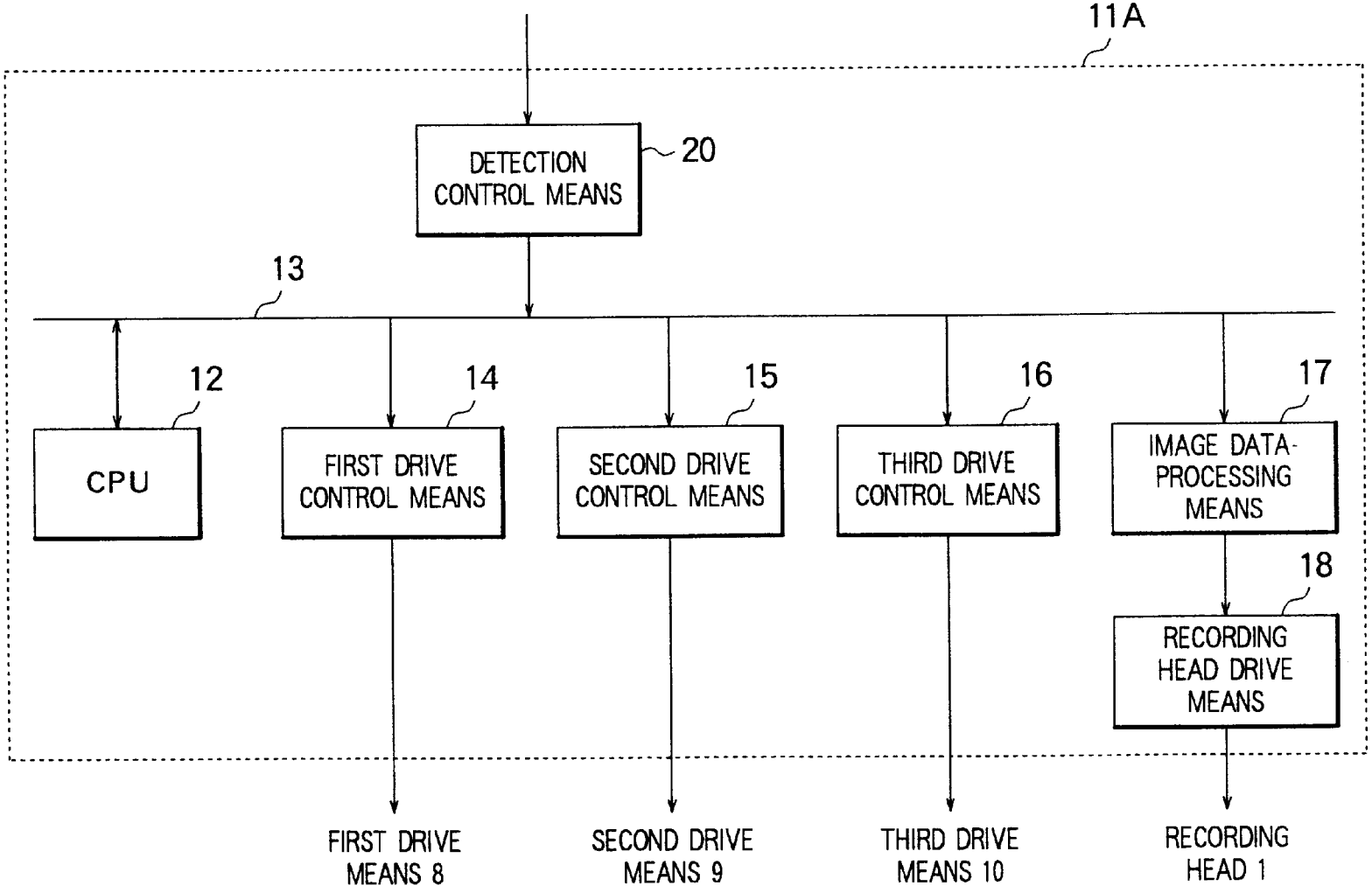
FIG. 14 is a structural chart for the control means 11 according to the embodiment 6 of the present invention.

The thermal recording apparatus according to the embodiment 6 shall be explained below with reference to FIG. 13 and FIG. 14. FIG. 13 is a structural drawing showing the thermal recording apparatus in the embodiment 6, and FIG. 14 is a drawing for explaining the constitution of a control means 11A. In these drawings, the same symbols as in FIG. 1 and FIG. 5 show the same or corresponding parts, and therefore the explanations shall be omitted. In FIG. 13, 19 is a detecting means (for example, an optical sensor) which detects the edge of a recorded medium 6. In FIG. 14, 20 is a detection control means which transmits a detection signal of the detecting means 19 to a CPU 12 through a control bus 13. In FIG. 13 and FIG. 14, 11A is a control means.

Next, the operations in FIG. 13 and FIG. 14 shall be explained. First, the recorded medium 6 is set on a platen 2 by means of an unillustrated recorded medium-transporting means or manual operation. A recording head 1 is loaded in a carriage 3*a*, and the carriage 3*a* is reciprocatively driven along a guide shaft 4*a* by means of a first drive means 8. Recording operations each are carried out in reciprocatively driving the recording head 1 loaded on the carriage 3*a*. To be specific, when the recording head 1 is driven in an arrow A direction, recording is carried out, and after finishing this main-scanning, the recording head 1 is driven by a distance of 3 dots in an arrow C direction by means of a second drive means 9. After finishing this drive, the recording head 1 is driven in an arrow B direction, and when the recording head 1 is driven in the arrow B direction, recording is carried out again. After finishing this main-scanning, the recording head 1 is driven by a distance of 3 dots in the arrow C direction by means of the second drive means 9, and then the recording head 1 is driven in the arrow A direction to carry out recording again. These operations are repeated to form images.

An image data formed in the control means 11A is input into the recording head 1, and intended recording is carried out on the recorded medium 6 via a recording medium 5. A difference from FIG. 1 resides in a sequence using the detecting means 19, and hereinafter, the explanations shall be restricted to the sequence described above.

First, if the control means 11A receives a command of "record" from an external host computer and the like, an edge at the left side of the recorded medium 6 is detected by means of the detecting means 19, and data processing as shown in FIG. 2 is carried out to record the data in order, wherein the edge at the left side of the recorded medium 6 is detected in order to clarify the start of printing an image (the start point of recording in a main-scanning line). After finishing the first main-scanning, an edge at the right side of the recorded medium 6 is detected by means of the detecting means 19. This is to clarify the end of printing an image (the end point of recording in a main-scanning line) and conform it to a position of the start of printing in main-scanning. Then, the carriage 3*a* is moved by a distance of prescribed dots in a sub-scanning direction by means of the second drive means 9. Then, the following operation is carried out in recording in an arrow B direction. First, the detecting means 19 transmits the detection results of the right end of the recorded medium 6 to a detection control means 20.

Then, a CPU 12 sends image data to the recording head 1 through an image data-processing means 17 at an intended timing with the detection results used as a trigger, and the image data are recorded in order. Then, sub-scanning feeding and main-scanning recording are repeated in the same manner to form images.

The constitution as described above provides the effects that high quality recording having no stripes between the main-scannings can be achieved at a low cost and the high speed printing apparatus can be achieved by two way printing. That is, position drift at a turning position can be reduced by providing the detecting means 19. In a method in which recording is carried out while filling up a space between main-scanning lines if a little drift is present, provided are the new effects that the image quality having no visual problems can be obtained and the inexpensive apparatus can be achieved. Further, there is the effect that a concentration drift characteristic of a thermal recording apparatus can apparently be removed (because a concentration drift direction can be dispersed in a two way not one way) by carrying out two way recording.

In this embodiment, the detecting means 19 is installed in the carriage 3*a* but may be installed in the recording head 1, and the installation position shall not be restricted. The position detected by the detecting means 19 has been set to the edge of the recorded medium 6 but may be an unillustrated marker on the recorded medium 6, the edge of an actually recorded image and a marker (not shown) on the platen 2 and shall not specifically be restricted. Further, the detecting means 19 may be omitted, and the CPU 12 may measure time for driving the first drive means 8 and a drive pulse to record an image to a timing thereof (in this case, to measure is defined as a detecting means). In any case, the constitution shall not specifically be restricted as long as it is a constitution in which two way printing is carried out by a method in which recording is carried out while filling up a space between main-scanning lines.

Embodiment 7

Figure 15A:
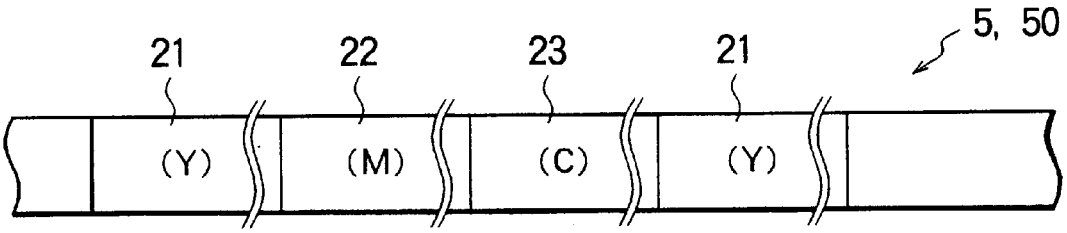
FIG. 15A is a plan of the serial type color recording medium 5 according to the embodiment 7 of the present invention.
Figure 15B:
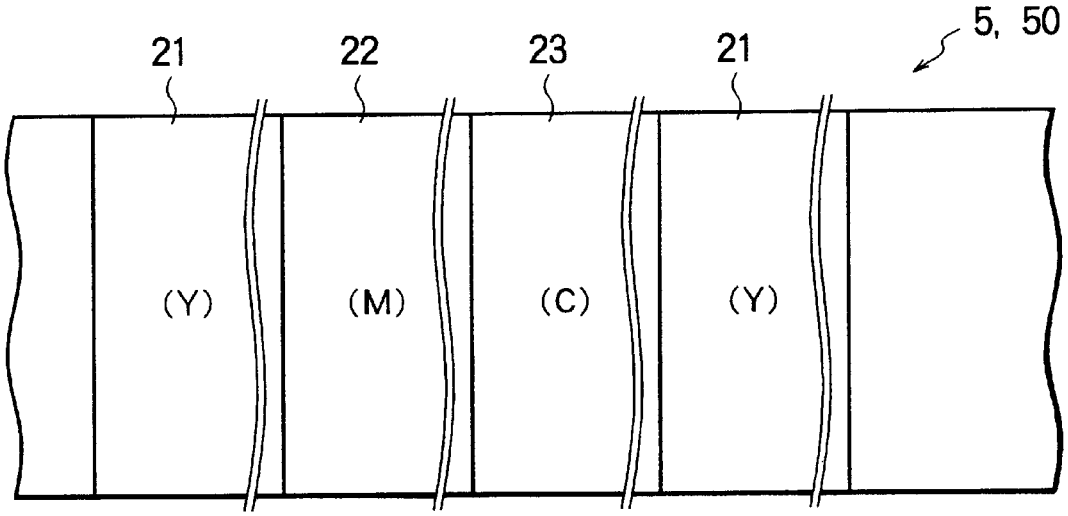
FIG. 15B is a plan of the line type color recording medium 5 according to the embodiment 7 of the present invention.

The embodiment 7 shall be explained below with reference to FIG. 15A and FIG. 15B. FIG. 15A and FIG. 15B are plans showing a color recording medium 50 used when full color recording is carried out in the constitutions of the embodiment 1 to the embodiment 6. FIG. 15A shows a serial type recording medium, and FIG. 15B shows a line type recording medium. Plural sets are prepared with yellow (Y) 21, magenta (M) 22 and cyan (C) 23 as one set of recording sections. If necessary, markers may be printed at the heads of the respective colors or black (B) may be provided at the end of the cyan (C) 23. The preceding marker of the recording medium is used for start setting, and a detecting means is provided, if necessary.

Next, the operations of embodiment 7 shall be explained using as an example the case where the serial type shown in FIG. 15A is used as the recording medium 5. Almost the same operations are shown in all the embodiments 1 to 6, and therefore explanation shall be given with reference to the embodiment 1 as a representative example while using FIG. 1. First, a recorded medium 6 is set on a platen 2. A recording head 1 is loaded in a carriage 3*a*, and the carriage 3*a* is reciprocatively driven along a guide shaft 4*a* by means of a first drive means 8. To be specific, when the recording head 1 is driven in an arrow A direction, recording corresponding to yellow (Y) is carried out. After finishing this main-scanning, the carriage 3*a* is moved in an arrow B direction by means of the first drive means 8 and returned to a position slightly this side from a record-starting position. Then, the carriage 3*a* is moved in the arrow A direction, and recording corresponding to magenta (M) is carried out in this movement. Then, the carriage 3*a* is moved in an arrow B direction by means of the first drive means 8 and returned to a position slightly this side from the record-starting position. Then, the carriage 3*a* is moved in the arrow A direction, and recording corresponding to cyan (C) is carried out in this movement. Then, the carriage 3*a* is moved by a distance of 3 dots in an arrow C direction by means of a second drive means 9 and moved again in the arrow B direction to return to a position slightly this side from the record-starting position. Then, the same operations are repeated, whereby images are formed.

As described above, the constitution in which a set of color elements of yellow (Y), magenta (M) and cyan (C) is recorded on the same scanning line by 3 scannings provides the effects that high quality recording having no stripes between the main-scannings can be achieved at a low cost and the recording apparatus having a high image quality close to that of a photograph can be achieved by color printing.

In this embodiment, the serial type recording medium shown in FIG. 15A has been explained, and the line type recording medium shown in FIG. 15B can be applied as well to FIG. 9, FIG. 10, FIG. 11 and FIG. 12. In this case, after finishing recording with one color, the recording medium is wound (detecting an unillustrated marker, if necessary) by means of a third drive means 10, and the next color can be recorded in the same manner. Then, 3 or 4 lap recordings can be carried out to achieve color recording.

Further, the plural recording head 1 may be used to carry out color recording by using plural ink cassettes at the same time for recording, or there can be employed the constitution in which plural ink cassettes are selectively used in one recording head 1.

Embodiment 8

Figure 16A:
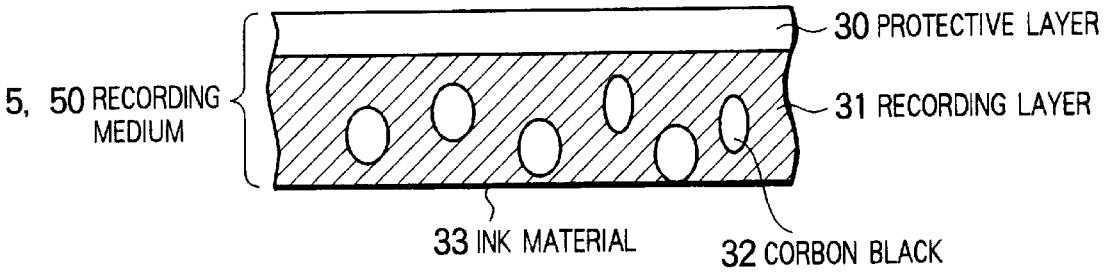
FIG. 16A is a cross section of the melt type color recording medium 5 according to the embodiment 8 of the present invention.
Figure 16B:
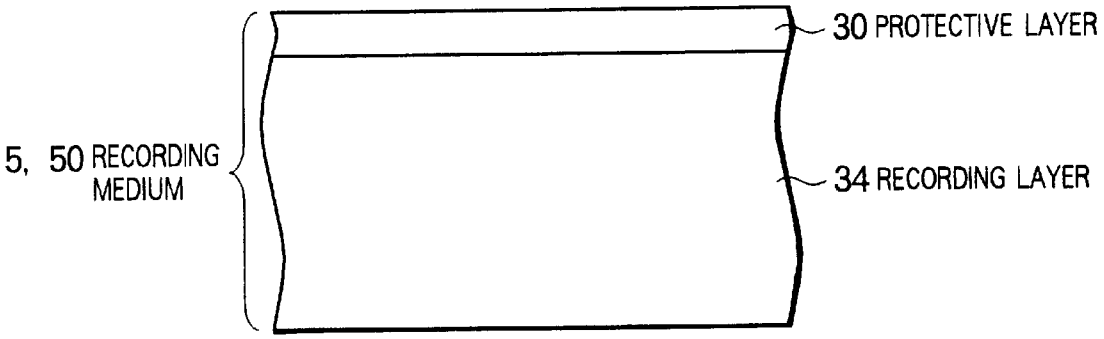
FIG. 16B is a cross section of the sublimation type color recording medium 5 according to the embodiment 8 of the present invention.
Figure 17:
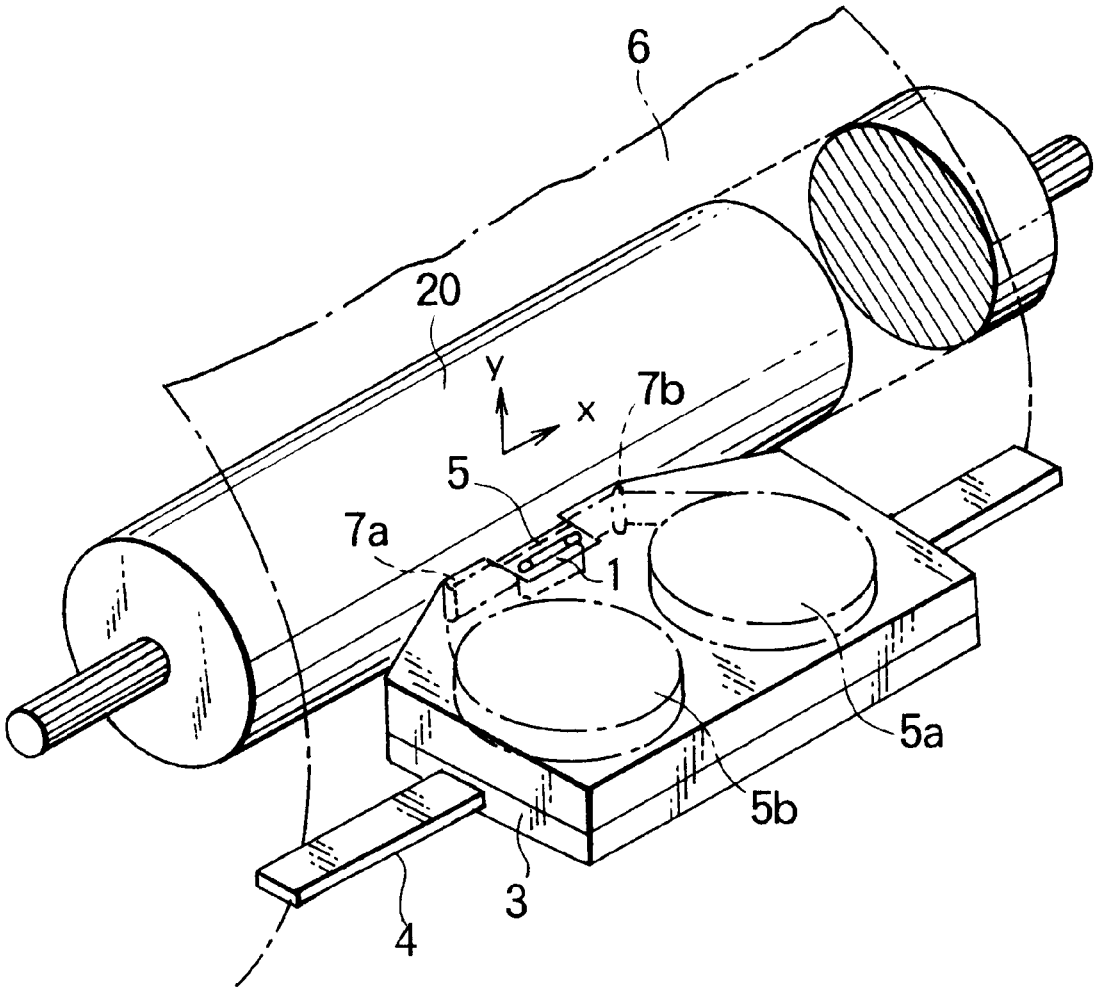
FIG. 17 PRIOR ART
FIG. 17 is a drawing showing the constitution of a conventional thermal recording apparatus.

The embodiment 8 shall be explained below with reference to FIG. 16A and FIG. 16B. FIG. 16A and FIG. 16B are cross sections showing a color recording medium 50 used when full color recording is carried out in the constitutions of the embodiment 1 to the embodiment 6. FIG. 16A shows a melt type recording medium 5, 50 which can repeatedly be used many times, and FIG. 16B shows a sublimation type recording medium 5, 50 which can repeatedly be used many times. In FIG. 16A and FIG. 16B, 30 is a protective layer; 31 is a melt type recording layer; and 34 is a sublimation type recording layer. The recording layer 31 has a stone wall structure formed by a strong coagulation force of carbon black 32 and the like and is composed of an ink material 33 comprising a pigment, a dye and low melting wax. In recording, the movement of the ink in the outside of a capillary structure formed by the stone wall makes plural time recording possible. Further, the constitution in which a porous structure comprising a heat resistant resin is impregnated with a melt type ink can provide as well the same effect. This recording medium 5, 50 is formed in a band shape, and connected are a start part thereof to a winding reel and an end part thereof to a feed reel.

Further, the recording medium 5, 50 shown in FIG. 16B contains a sublimation dye as a coloring material in the recording layer 34, and the constitution in which the recording layer has a larger thickness than those of conventional ones makes plural time recording possible. Usually, a dye is transferred from a side closer to a recorded medium by heat of a recording head. In this case, however, the dye moves (in order to supplement the transferred dye in the inside) so that a concentration gradient disappears in the recording layer 34, and therefore plural time recording can be achieved. A lubricant layer may be provided, if necessary, in the lower part of the recording layer 34, or a lubricant layer may be provided in a recorded medium side. Further, a difference between the running speeds of the recording medium 5, 50 and the recorded medium 6 may be provided to carry out recording.

Next, the operations of embodiment 8 shall be explained using as an example the case where the melt type shown in FIG. 16A is used as the recording medium 5, 50. Almost the same operations are shown in all the embodiment 1 to the embodiment 6, and therefore explanation shall be given with reference to the embodiment 1 as a representative example while using FIG. 1. First, the recorded medium 6 is set on a platen 2. A recording head 1 is loaded on a carriage 3*a* and driven along a guide shaft 4*a* to carry out recording. To be specific, when the recording head 1 is driven in an arrow A direction, recording is carried out. After finishing this main-scanning, the carriage 3*a* is moved in an arrow B direction and returned to a position slightly this side from a record-starting position. In this case, the recording medium 5 is returned to a feed roll 5*a* side by a prescribed distance by means of a third drive means 10, and the used part is rewound. Then, after driving the carriage 3*a* by a distance of 3 dots in an arrow C direction by means of a second drive means 9, it is moved in the arrow A direction. In this movement, the recording medium 5 positioned in almost the same used part is used again for recording. The same operations are repeated while using the recording medium 5 of the same place plural times, whereby an image is formed. The number of times to use the recording medium 5 is varied according to the printing rate of an image data, and a CPU 12 in a control means 11 decides the recording frequency to change the sequence.

The constitution as described above provides the effects that high quality recording having no stripes between the main-scannings can be achieved at a low cost and that the same recording medium is used plural times, and therefor the low running cost can be achieved.

In this embodiment, the melt type recording medium shown in FIG. 16A has been explained, and the same effects shall be provided as well if the sublimation type recording medium shown in FIG. 16B is used.

When it is applied to, for example, the thermal recording apparatus shown in FIG. 7, there may be employed as well the constitution in which recording in a main-scanning direction is carried out plural times, and then the recording medium 5 of the next section is fed by means of the third drive means 10. In the case of FIG. 1 and FIG. 9, there can be taken the constitution in which almost all the recording medium 5 is used, and then the whole thereof is rewound for reuse, and specific restrictions shall not be put thereon. Further, in the case of FIG. 9, there may be employed the constitution in which yellow (Y) 21, magenta (M) 22 and cyan (C) 23 are recorded in order, and then the recording medium is rewound with a set of the recording sections as one unit and used again.

As described above, according to the invention asdescribed in claims 1 and 2, the thermal recording apparatus is equipped with the recording head in which p pieces of recording elements for recording dots on the recorded medium are disposed at an interval of k dots (provided that p and k are positive integers which become a prime to each other) in a sub-scanning direction, the first drive means for driving the recording head described above in the main-scanning direction, the second drive means for driving the recording head by a distance of p dots every sub-scanning in the sub-scanning direction, the third drive means for driving the recording medium disposed so that it contacts the recorded medium described above, and the control means for controlling the first, second and third drive means and outputting image data to be recorded on the preceding recorded medium to the recording head described above. Accordingly, provided is the effect that high quality recording having no stripes between the main-scannings can be achieved at a low cost.

According to the present invention, the thermal recording apparatus is equipped with the recording head in which p pieces of recording elements for recording dots on the recorded medium are disposed at an interval of k dots (provided that p and k are positive integers which become a prime to each other) in a sub-scanning direction, the first drive means for driving the recording head described above in the main-scanning direction, the second drive means for driving the recorded medium described above by a distance of p dots every sub-scanning in the sub-scanning direction, the third drive means for driving the recording medium disposed so that it contacts the recorded medium described above, and the control means for controlling the first, second and third drive means and outputting image data recorded to be on the preceding recorded medium to the recording head described above. Accordingly, provided are the effects that high quality recording having no stripes between the main-scannings can be achieved at a low cost and the apparatus having a small installation area can be obtained.

Further, according to the present invention a control means controls the first drive means and the third drive means so that they are driven at different times. Accordingly, provided are the effects that high quality recording having no stripes between the main-scannings can be achieved at a low cost and that since the third drive means is not operated at the same time as the first drive means, the power consumption is suppressed and as a result thereof, the power source can be inexpensive and small.

According to another aspect of the present invention, a set of the recording sections of the recording medium is larger than a recording size in the recorded medium, and therefore provided are the effects that high quality recording having no stripes between the main-scannings can be achieved at a low cost and recording at a low running cost can be achieved.

Further, according to another aspect of the present invention, the driving direction of the recording medium is approximately the same as that of the recording head, and therefore provided are the effects that high quality recording having no stripes between the main-scannings can be achieved at a low cost and that recording at a low running cost can be achieved and that creases are less liable to be produced on the recording medium, and high quality recording is stably obtained.

According to another aspect of the present invention, the start point and the end point of recording in the main-scanning line are detected by means of the detecting means, and the control means controls the recording head described above by this signal so that recording operations are carried out in coming and going drives of the recording head respectively. Accordingly, provided is the effect that the high speed printing apparatus having a high image quality achieved by two way printing can be obtained.

Further, according to another aspect of the present invention, the color recording medium is used, and therefore obtained is the effect that the recording apparatus having a high image quality close to that of a photograph can be achieved.

According to another aspect of the present invention, the recording medium is formed in a band shape, and connected are a start part thereof to a winding reel and an end part thereof to a feed reel. The control means controls the third drive means described above so that the used part of the recording medium described above is rewound for reuse, and therefore provided are the effects that the recording medium can be used for recording plural times and the low running cost can be achieved.

What is claimed is:

1. A serial thermal recording apparatus comprising:

a recording head in which p pieces of recording elements for recording dots on a recorded medium are disposed at an interval of k dots (provided that p and k are positive integers which become prime to each other) in a sub-scanning direction;

a first drive means for driving said recording head in a main-scanning direction;

a second drive means for driving one of the recorded medium and the recording head in a direction in which the recording head is moved relative to the recorded medium by a distance of p dots every sub-scanning in the sub-scanning direction, a recording medium disposed so that it contacts the recorded medium and provided thereon with a recording material for recording on the recorded medium;

a third drive means for driving said recording medium; and a control means for controlling the first, second and third drive means and outputting image data to be recorded on the recorded medium to the recording head.

2. The serial thermal recording apparatus as described in claim 1, wherein said second drive means drives the recording head.

3. The serial thermal recording apparatus as described in claim 1, wherein said second drive means drives the recorded medium.

4. The serial thermal recording apparatus as described in claim 1, wherein said control means controls the first drive means and the third drive means so as to drive said first drive means and said second drive means at different times.

5. The serial thermal recording apparatus as described in claim 1, wherein one set of recording sections in the recording medium is larger than a size of recording on the recorded medium.

6. The serial thermal recording apparatus as described in claim 1, wherein the driving direction of the recording medium is almost the same as that of the recording head.

7. The serial thermal recording apparatus as described in claim 1, further comprising:

a detecting means for detecting a start point and an end point of recording in a main-scanning line to output a signal to the control means, and wherein the control means uses the signal from the detecting means to control the recording head so as to operate recording in coming and going drives respectively.

8. The serial thermal recording apparatus as described in claim 1, wherein said recording medium is constituted so that one set of the recording sections includes the color materials of yellow (Y), magenta (M) and cyan (C), and said control means controls the recording head so as to repeat recording three times for yellow (Y), magenta (M) and cyan (C) on the same main-scanning line with the recording head.

9. The serial thermal recording apparatus as described in claim 1, wherein said recording medium is formed in a band shape and constituted so that a start part is connected to a winding reel and an end part is connected to a feed reel, and the used part is wound on the winding reel, and the control means controls the third drive means so that the used part of the recording medium is rewound for reuse.

* * * * *